US012077967B2

(12) United States Patent
Boo

(10) Patent No.: US 12,077,967 B2
(45) **Date of Patent: *Sep. 3, 2024**

(54) BUILDING PANEL AND LOCKING DEVICES THEREFORE

(71) Applicant: Välinge Innovation AB, Viken (SE)

(72) Inventor: Christian Boo, Kågeröd (SE)

(73) Assignee: Välinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/709,930

(22) Filed: Mar. 31, 2022

(65) Prior Publication Data

US 2022/0316219 A1 Oct. 6, 2022

(30) Foreign Application Priority Data

Apr. 1, 2021 (SE) ..... 2150420-4
Apr. 16, 2021 (SE) ..... 2150478-2

(51) Int. Cl.
*E04F 15/02* (2006.01)

(52) U.S. Cl.
CPC .. *E04F 15/02038* (2013.01); *E04F 15/02011* (2013.01); *E04F 15/02016* (2013.01); *E04F 15/02033* (2013.01); *E04F 2201/0115* (2013.01); *E04F 2201/0146* (2013.01); *E04F 2201/0161* (2013.01); *E04F 2201/023* (2013.01); *E04F 2201/026* (2013.01)

(58) Field of Classification Search
CPC ..... E04F 15/02038; E04F 15/02011; E04F 15/02016; E04F 15/02033; E04F 2201/0115; E04F 2201/0146; E04F 2201/0161; E04F 2201/023; E04F 2201/026; E04F 2201/0547
USPC ..... 52/586.1, 582.1, 582.2
See application file for complete search history.

(56) References Cited

U.S. PATENT DOCUMENTS

| | | | | |
|---|---|---|---|---|
| 7,584,583 | B2 * | 9/2009 | Bergelin | E04F 15/02188 52/177 |
| 8,511,031 | B2 | 8/2013 | Bergelin et al. | |
| 11,203,877 | B2 | 12/2021 | Ylikangas | |
| 2008/0134614 | A1 * | 6/2008 | Pervan | E04F 21/22 52/588.1 |

(Continued)

OTHER PUBLICATIONS

U.S. Appl. No. 16/738,602 (Cited herein as U.S. Patent Application Publication No. 2021/0087827 A1 of Mar. 25, 2021), Roger Ylikangas, Anders Nilsson and Karl Quist, filed Jan. 9, 2020.

(Continued)

*Primary Examiner* — Brent W Herring
(74) *Attorney, Agent, or Firm* — Boone IP Law

(57) ABSTRACT

A building panel, such as a floor panel or wall panel, has a first mechanical locking device at a respective first edge 11 and an opposite second edge, such as long edges, for horizontal and vertical locking of similar or essentially identical building panels in an assembled position. The building panel further has a second mechanical locking device at a respective third edge and an opposite fourth edge for horizontal and vertical locking of similar building panels or essentially identical building panels in an assembled position. The first mechanical locking device includes, at the first edge, a tongue groove 111 configured to receive a first locking tongue at the second edge.

16 Claims, 20 Drawing Sheets

(56) References Cited

U.S. PATENT DOCUMENTS

| | | | | |
|---|---|---|---|---|
| 2009/0049787 | A1* | 2/2009 | Hannig | E04F 15/107 52/589.1 |
| 2010/0281803 | A1* | 11/2010 | Cappelle | E04F 15/045 52/309.1 |
| 2011/0030303 | A1* | 2/2011 | Pervan | E04F 15/02005 83/13 |
| 2013/0232905 | A2* | 9/2013 | Pervan | E04F 15/107 52/582.2 |
| 2015/0047284 | A1* | 2/2015 | Cappelle | E04F 15/02005 52/311.1 |
| 2015/0330088 | A1* | 11/2015 | Derelov | E04F 15/02038 52/588.1 |
| 2015/0337542 | A1* | 11/2015 | Cappelle | E04F 15/10 52/309.1 |
| 2016/0153200 | A1* | 6/2016 | Pervan | E04F 15/102 52/582.2 |
| 2016/0340913 | A1* | 11/2016 | Derelov | A47B 47/00 |
| 2017/0037640 | A1* | 2/2017 | Boucké | E04F 15/107 |
| 2018/0305937 | A1* | 10/2018 | Cappelle | E04F 15/02 |
| 2020/0181923 | A1* | 6/2020 | Quist | E04F 15/02155 |
| 2021/0087827 | A1 | 3/2021 | Ylikangas et al. | |
| 2021/0087828 | A1 | 3/2021 | Ylikangas et al. | |
| 2021/0087829 | A1 | 3/2021 | Ylikangas et al. | |
| 2021/0087830 | A1 | 3/2021 | Ylikangas et al. | |
| 2021/0198901 | A1* | 7/2021 | Josefsson | B32B 27/065 |
| 2021/0310256 | A1* | 10/2021 | Boo | E04F 13/0894 |
| 2022/0127850 | A1 | 4/2022 | Boo | |
| 2022/0178150 | A1 | 6/2022 | Ylikangas et al. | |

OTHER PUBLICATIONS

U.S. Appl. No. 17/029,644 (Cited herein as U.S. Patent Application Publication No. 2021/0087830 A1 of Mar. 25, 2021), Roger Ylikangas, Anders Nilsson and Karl Quist, filed Sep. 23, 2020.

U.S. Appl. No. 17/505,229 (Cited herein as U.S. Patent Application Publication No. 2021/0087850 A1 of Apr. 28, 2022), Christian Boo, filed Oct. 19, 2021.

U.S. Appl. No. 17/524,952 (Cited herein as U.S. Patent Application Publication No. 2021/0178150 A1 of Jun. 9, 2022), Roger Ylikangas, Anders Nilsson and Karl Quist, filed Nov. 12, 2021.

U.S. Appl. No. 17/642,348, Roger Ylikangas, Anders Nilsson and Karl Quist, filed Mar. 11, 2022.

Ylikangas, Roger, et al., U.S. Appl. No. 17/642,348 entitled "Building Panel," filed in the U.S. Patent and Trademark Office filed Mar. 11, 2022.

* cited by examiner

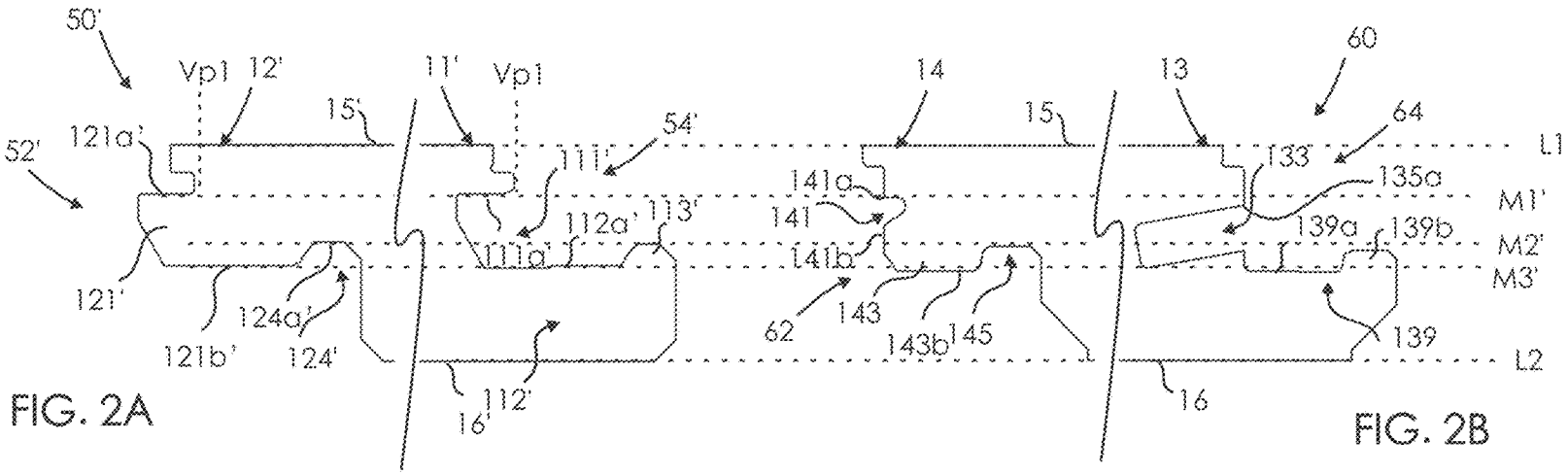
FIG. 2A
FIG. 2B
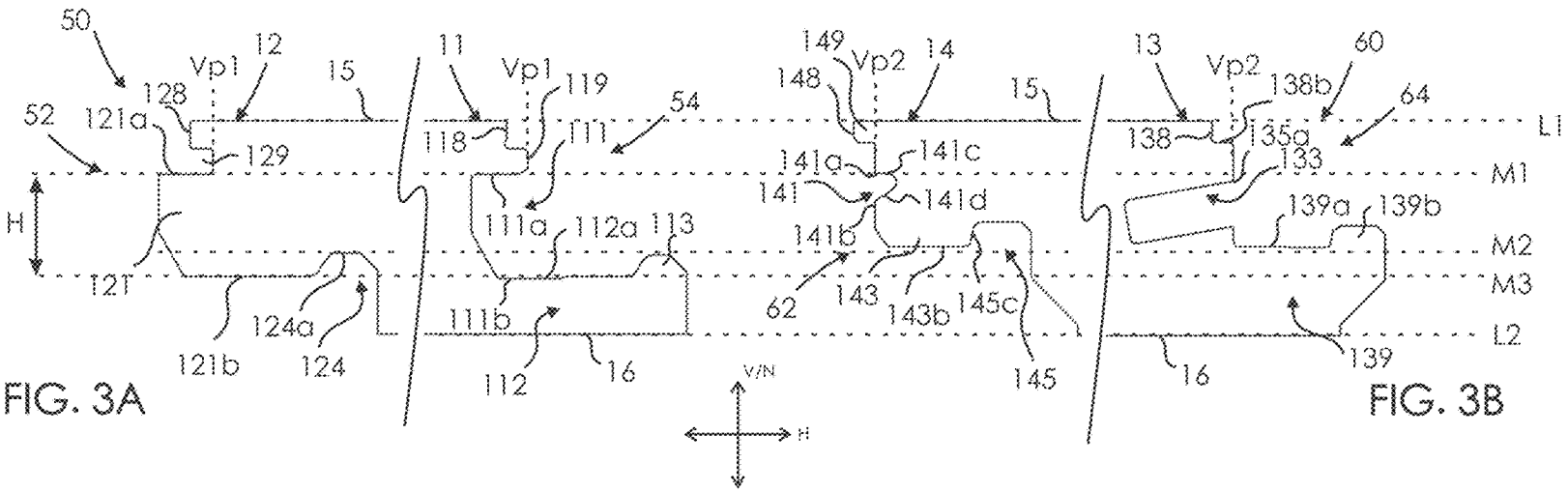
FIG. 3A
FIG. 3B

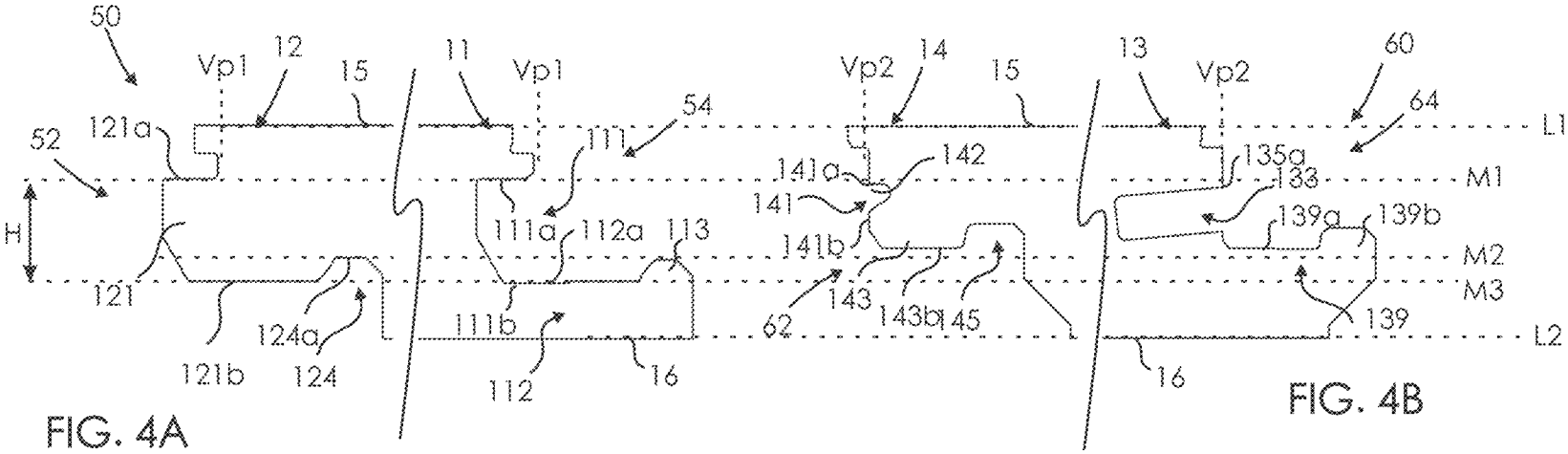
FIG. 4A
FIG. 4B
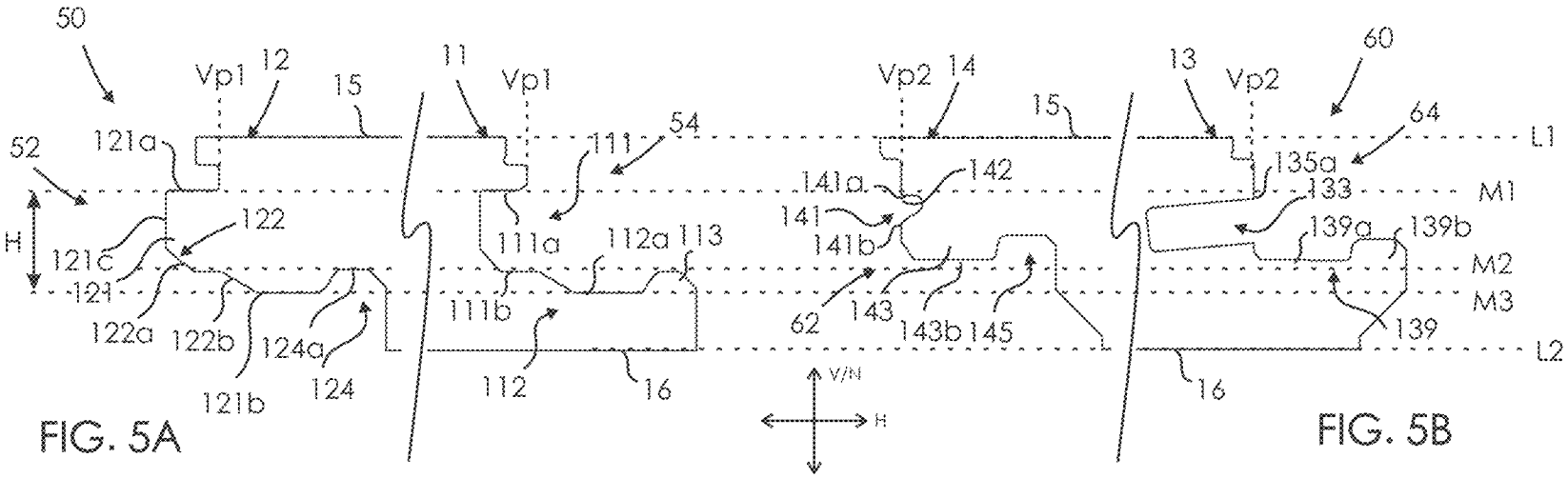
FIG. 5A
FIG. 5B

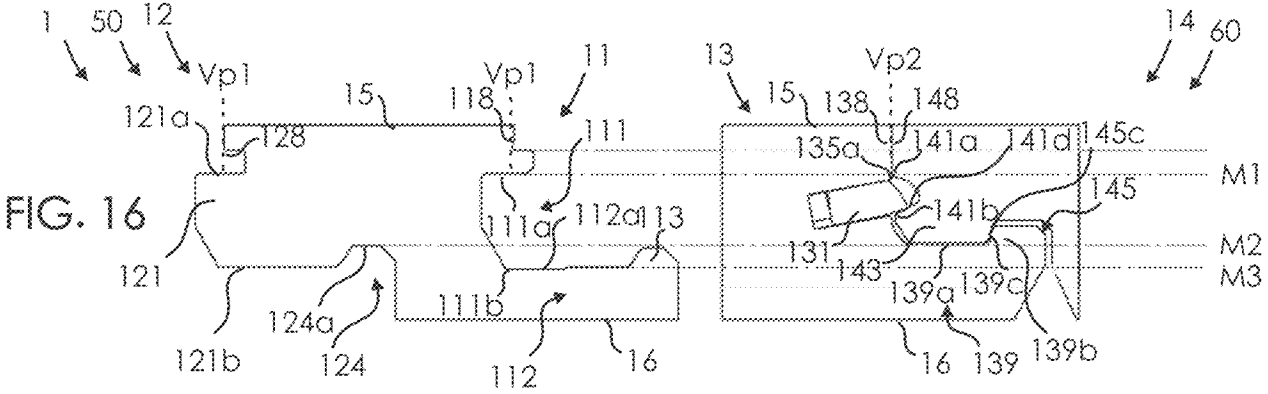
FIG. 16
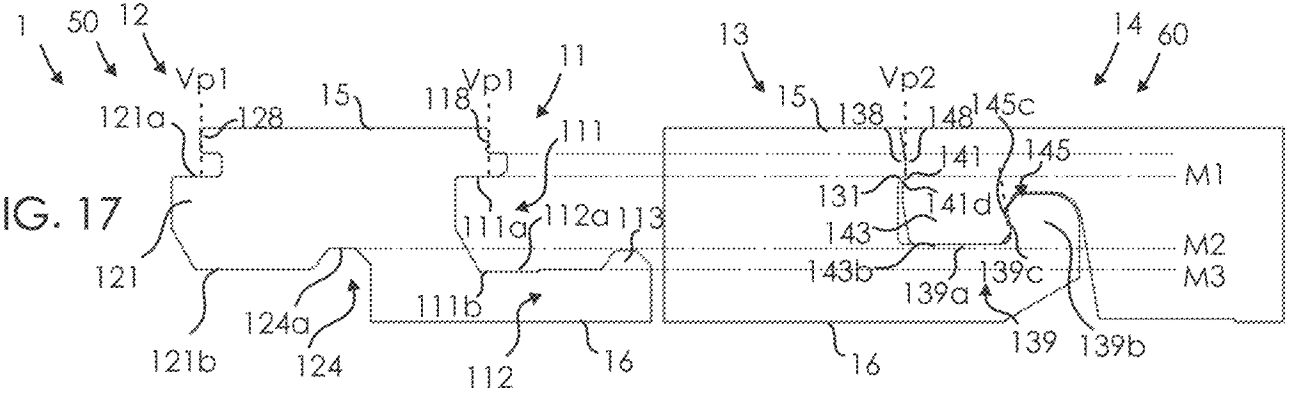
FIG. 17
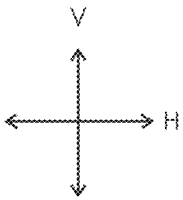

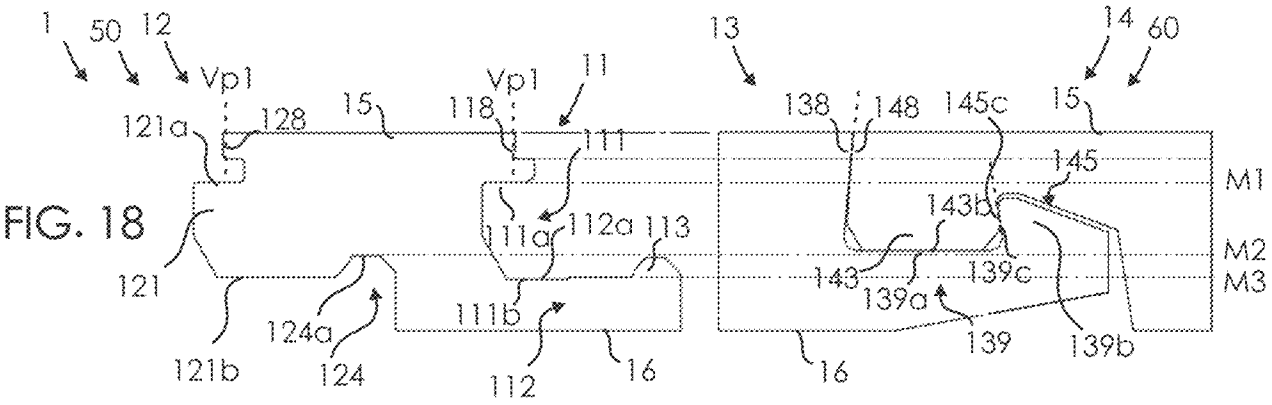
FIG. 18
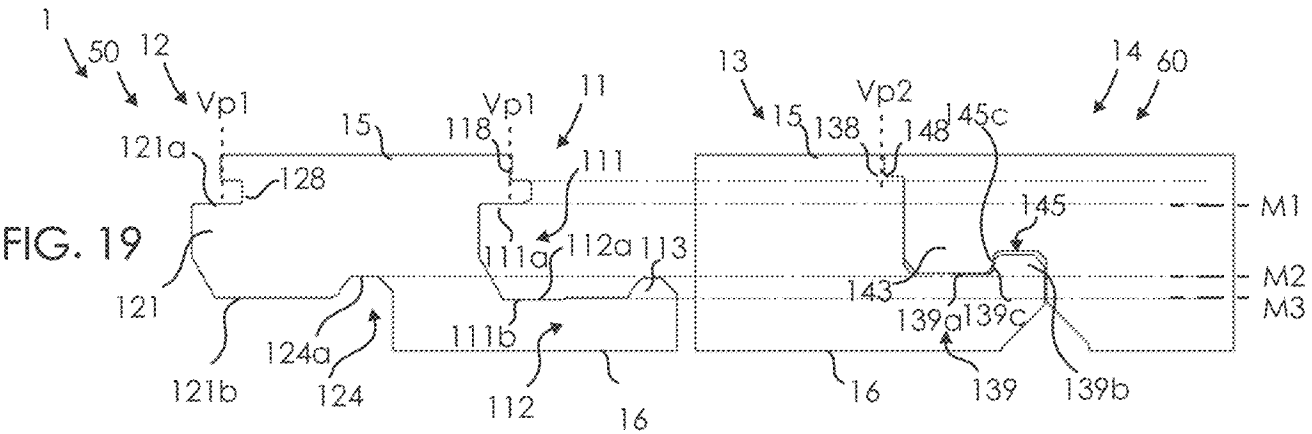
FIG. 19
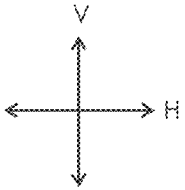

BUILDING PANEL AND LOCKING DEVICES THEREFORE

CROSS REFERENCE TO RELATED APPLICATIONS

The present application claims the benefit of Swedish Application No. 2150420-4, filed on Apr. 1, 2021 and of Swedish Application No. 2150478-2, filed on Apr. 16, 2021. The entire contents of each of Swedish Application No. 2150420-4 and Swedish Application No. 2150478-2 are hereby incorporated herein by reference in their entirety.

TECHNICAL FIELD

The present disclosure relates to building panels, in particular aspects of the present disclosure relates to locking devices for building panels, more in particular, some aspects of the present disclosure relate to fluid permeability of such locking devices.

BACKGROUND

There are known building panels comprising a first mechanical locking device, typically along opposite long edges, for assembling of adjacent building panels in a locked position by means of a folding displacement. There are also known building panels comprising a second mechanical locking device, typically along opposite short edges, for assembling adjacent building panels in a locked position by means of a vertical displacement curtesy of a displaceable locking tongue.

Although such known building panels, in some aspects, may represent well-functioning building panels, there is still room for improvements in the technical field.

The above references to the background art do not constitute an admission that the art forms a part of the common general knowledge of a person of ordinary skill in the art. The above references are also not intended to limit the application of the joint system as disclosed herein.

SUMMARY

Accordingly, embodiments of the present invention preferably seek to mitigate, alleviate or eliminate one or more deficiencies, disadvantages or issues in the art, such as the above-identified, singly or in any combination by providing a building panel, such as a floor panel or wall panel, comprising a first mechanical locking device at a respective first edge and an opposite second edge, such as long edges, for horizontal and vertical locking of similar or essentially identical building panels in an assembled position; a second mechanical locking device at a respective third edge and an opposite fourth edge for horizontal and vertical locking of similar building panels or essentially identical building panels in an assembled position, wherein the first mechanical locking device comprises at the first edge a tongue groove configured to receive a first locking tongue of the second edge. In one embodiment the first locking tongue is configured to accommodate at least partly the second mechanical locking device therein.

An aspect of the inventive concept is to provide a building panel or a set of such building panels, such as a floor panel or wall panel, including:

a front surface and a back surface each extending between a first edge and an opposite second edge, and a between a third edge and an opposite fourth edge, wherein the back surface is parallel and spaced apart to the front surface in a direction perpendicular to the front surface;

a first mechanical locking device arranged at the respective first edge and the opposite second edge for locking of similar or essentially identical building panels in directions parallel and perpendicular to the front surface in an assembled position;

a second mechanical locking device arranged at the respective third edge and the opposite fourth edge for locking of similar building panels or essentially identical building panels in directions parallel and preferably perpendicular to the front surface in an assembled position, wherein the first mechanical locking device comprises, at the second edge, a locking tongue configured to cooperate with a tongue groove of a first mechanical locking device of an adjacent building panel, arranged at the first edge of the adjacent building panel for locking the building panels in at least a direction perpendicular to the front surface in an assembled position, wherein the second mechanical locking device comprises, at the third edge, a locking strip comprising a locking element configured to cooperate with a locking groove of a second mechanical locking device of an adjacent building panel, arranged at the fourth edge of the adjacent building panel for locking the building panels in at least a direction parallel to the front surface in an assembled position, wherein the locking tongue of the first mechanical locking device comprises a lowermost surface configured to cooperate with an upper surface of a locking strip of the first mechanical locking device of the adjacent building panel, arranged at the first edge of the adjacent building panel, in an assembled position, and wherein a plane M3 extending parallel with the front surface and through the lowermost surface of the locking tongue of the first mechanical locking device extends through the locking strip of the second mechanical locking device.

An advantage with the building panel as defined above is that, by providing or forming the lowermost surface of the locking tongue in the plane M3 extending through the locking strip, a lowermost point of an upper surface of the locking strip may continuously overlap the locking tongue at the intersection between the respective edges, at which they are arranged. The lower surface of the locking tongue is also at the intersection able to seal against the upper surface of the locking strip of the first mechanical locking device at the first edge of an adjacent building panel, when assembling the building panels and maintain that seal in the assembled position of the building panels. A further advantage with that is that this decreases the risk of fluid, coming from the front surface, of migrating further into the building panel.

In an embodiment the plane M3 extends between an upper surface and a lower surface of the locking strip of the second mechanical locking device.

In another embodiment a lowermost point of the upper surface of the locking strip of the second mechanical locking device is arranged above the plane in a direction perpendicular to the front surface.

The locking strip may comprises an upper surface configured to cooperate with a lowermost surface of a lower edge portion of a second mechanical locking device of an adjacent building panel, arranged at the fourth edge of the adjacent building panel for locking the building panels in at least a direction parallel to the front surface in an assembled position, and wherein a lowermost point of the upper surface of the locking strip is arranged above the plane M3 in a direction perpendicular to the front surface.

The second mechanical locking device may further comprise, at the third edge, an insertion groove configured to cooperate with a displaceable locking tongue and a wedge groove of a second mechanical locking device of an adjacent building panel, arranged at the fourth edge of the adjacent building panel for locking the building panels in at least a direction perpendicular to the front surface in an assembled position.

In an embodiment the insertion groove is formed to slope towards the back surface of the building panel, wherein a slope angle may be less than 10°, less than 7° or about 5° in relation to a plane parallel to the front surface.

In another embodiment a lowermost point of the insertion groove of the second mechanical locking device is arranged above the plane M3 in a direction perpendicular to the front surface.

In yet another embodiment the height of the locking tongue, between the uppermost surface and the lowermost surface in the direction perpendicular to the front surface, is configured to accommodate the insertion groove.

The height of the locking tongue, between the uppermost surface and the lowermost surface in the direction perpendicular to the front surface, may be configured to accommodate the insertion groove, the displaceable locking tongue and the wedge groove.

The height of the locking tongue, between an uppermost surface and the lowermost surface in the direction perpendicular to the front surface, may further be configured to accommodate the insertion groove, the displaceable locking tongue, the wedge groove, the upper surface of the locking strip and at least an upper portion of the locking element.

In an embodiment the locking tongue of the first mechanical locking device comprises a surface portion at least partly sloping towards the back surface of the building panel, wherein the surface portion extends from an outermost surface of the locking tongue to the lower surface of the locking tongue.

The surface portion may comprise at least two sloping surface sections sloping towards the back surface of the building panel and in towards the building panel.

In an embodiment the sloping surface section ending at the lower surface of the locking tongue is configured to start above a plane M2, defined by the uppermost portion of a locking element of the locking strip of the first mechanical locking device, such as at least 0.5 mm above the plane M2, or at least 1 mm above the plane M2.

In another aspect of the inventive concept there is provided a set of building panels according to any embodiment as described above.

Further embodiments being described in the appended claims and the ITEM section.

BRIEF DESCRIPTION OF DRAWINGS

These and other aspects, features and advantages of which embodiments of the invention are capable of, will be apparent and elucidated from the following description of embodiments of the present invention, reference being made to the accompanying drawings, in which

FIG. 2A is a schematic illustration of an exemplary first locking device.

FIG. 2B is a schematic illustration of a second mechanical locking device according to an embodiment.

FIG. 3A is a schematic illustration of a first mechanical locking device according to an embodiment.

FIG. 3B is a schematic illustration of a second mechanical locking device according to an embodiment.

FIG. 4A shows the embodiment of FIG. 3A.

FIG. 4B is a schematic illustration of a second mechanical locking device according to an embodiment.

FIG. 5A is a schematic illustration of a first mechanical locking device according to an embodiment.

FIG. 5B shows the embodiment of FIG. 4B.

FIG. 16 is a schematic illustration of a first mechanical locking device according to an embodiment and a second mechanical locking device according to an embodiment.

FIG. 17 is a schematic illustration of a first mechanical locking device according to an embodiment and a second mechanical locking device according to an embodiment.

FIG. 18 is a schematic illustration of a first mechanical locking device according to an embodiment and a second mechanical locking device according to an embodiment.

FIG. 19 is a schematic illustration of a first mechanical locking device according to an embodiment and a second mechanical locking device according to an embodiment.

DETAILED DESCRIPTION

Figure 1A:
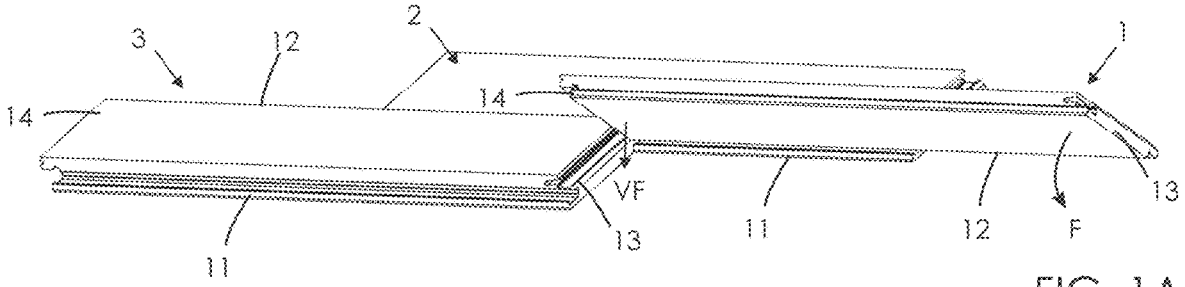
FIG. 1A is a schematic illustration of a set of building panels where a first building panel is being assembled to an adjacent second building panel by means of a folding displacement, and to a third adjacent building panel by means of a vertical displacement.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements. Generally, in this disclosure, terms like "below" or "lower" typically implies closer to the back surface 16 of the building panel or a plane thereof, whereas "above" or "upper" implies closer to the front surface 15 or a plane thereof. The thickness direction of the building panel is defined as the vertical V direction when the building panel lays flat on a surface.

Figure 1B:
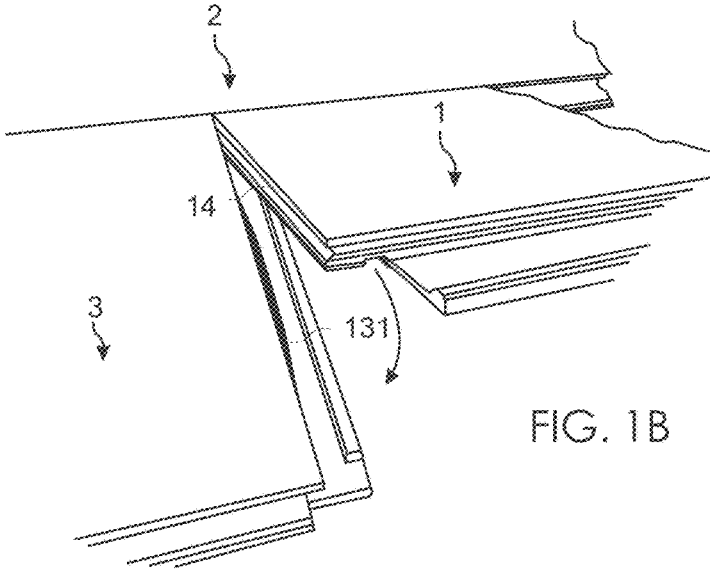
FIG. 1B shows details of FIG. 1A.
Figure 1C:
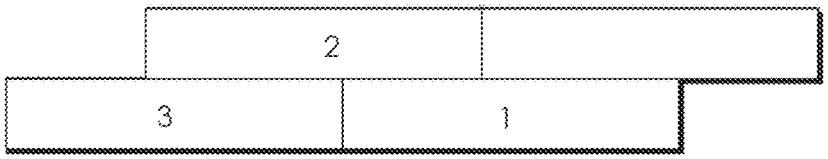
FIG. 1C is a schematic illustration of a set of building panels configured in assembled positions.

FIGS. 1A-1C show a set of exemplary building panels 1, 2 and 3 assembled in a locked position. The building panels 1, 2, 3 may for example be floor panels, wall panels, ceiling panels, furniture elements or similar. Each building panel 1, 2, 3 includes four side edges, the first edge 11, the second edge 12, the third edge 13 and the fourth edge 14. The first edge are arranged opposite the second edge and the third edge are arranged opposite the fourth edge.

Each building panel 1, 2, 3 further includes a front surface 15 and a back surface 16. The front surface 15 and the back surface 16 each extends between the first edge 11 and the opposite second edge 12, and between the third edge 13 and the opposite fourth edge 14. The back surface 16 is parallel to the front surface 15 and displaced in a direction perpendicular to the front surface 15.

Each building panel 1, 2, 3 includes at least one type of a mechanical locking device 50, 50', 60 which is configured for horizontal and vertical locking of similar or essentially identical building panels in an assembled position by means of a folding and/or vertical displacement. Embodiments of the mechanical locking devices 50, 50', 60 are illustrated in FIG. 2A and forward.

The mechanical locking device 50, 50', 60 is arranged along the edges 11-14 of the building panel 1, 2, 3. In the illustrated embodiments a building panel 1, 2, 3 is provided with two types of mechanical locking devices, a first mechanical locking device 50, 50' and a second mechanical locking device 60. The first mechanical locking device 50, 50' is arranged along the first and second edges 11, 12, which preferably are the long sides of the building panel 1, 2, 3 if the building panel 1, 2, 3 has a rectangular shape. The second mechanical locking device 60 is arranged along the third and fourth edges 13, 14, which preferably are the short sides of the building panel 1, 2, 3 if the building panel 1, 2, 3 has a rectangular shape.

Each mechanical locking device 50, 50', 60 has connecting means 52, 52', 62 and counter connecting means 54, 54', 64 where the connecting means 52, 52', 62 are arranged on the first edge 11 and the third edge 13 respectively and the counter-connecting means 54, 54', 64 are arranged on the second edge 12 and the fourth edge 14 respectively. Each connecting means 52, 52', 62 are configured to be compatible with respective counter-connecting means 54, 54', 64 such that a connecting means 54, 54', 64 of a mechanical locking device 50, 50', 60 of a first building panel 1, 2, 3 may be assembled and vertically and horizontally locked to a counter-connecting means 54, 54', 64 of a mechanical locking device 50, 50', 60 of an adjacent building panel 1, 2, 3.

The first building panel 1 is assembled to the second building panel 2 by means of a first mechanical locking device 50 provided at the first edge 11 and opposite second edge 12. The first mechanical locking device 50 is configured for assembling of adjacent building panels 1 and 2 in a horizontal and vertical locked position by means of a folding F displacement, as illustrated in FIG. 1A. to the third edge 13 of the third building panel 3, as illustrated in FIGS. 1A-1C.

The building panels further comprise a second mechanical locking device 60 at respective third edges 13 and fourth edges 14. The first building panel 1 and the adjacent third building panel 3 are assembled by means of the second mechanical locking device 60. The second mechanical locking device is configured for assembling of adjacent building panels 1 and 3 in a horizontal and vertical locked position by means of a vertical displacement, such as vertical folding VF, as illustrated in FIG. 1A. Whereby the fourth edge 14 is effectively displaced vertically in relation to the third edge 13 of the adjacent third building panel 3.

Figures 6A, 6B:
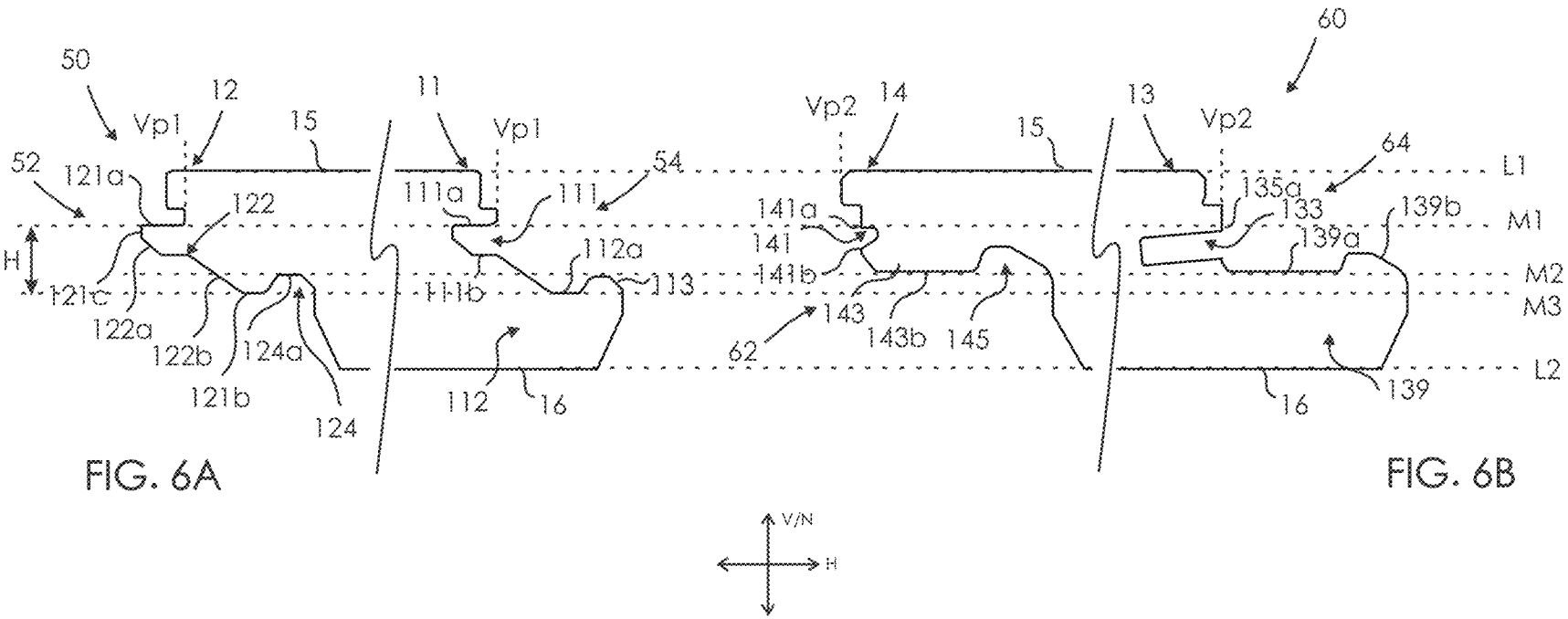
FIG. 6A is a schematic illustration of a first mechanical locking device according to an embodiment.
FIG. 6B is a schematic illustration of a second mechanical locking device substantially similar to the embodiment in FIG. 4B FIGS. 7A-7D show an exemplary building panel comprising an exemplary first locking device.
Figure 7A:
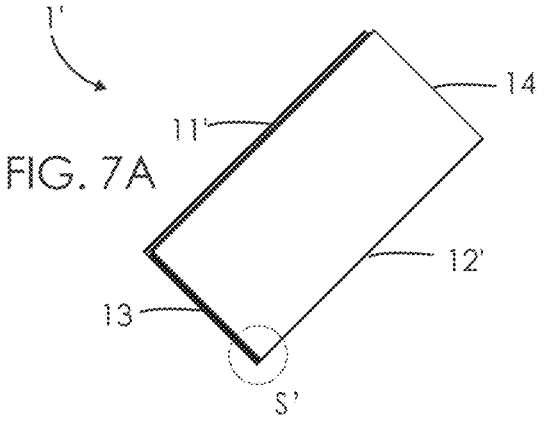
Figure 7B:
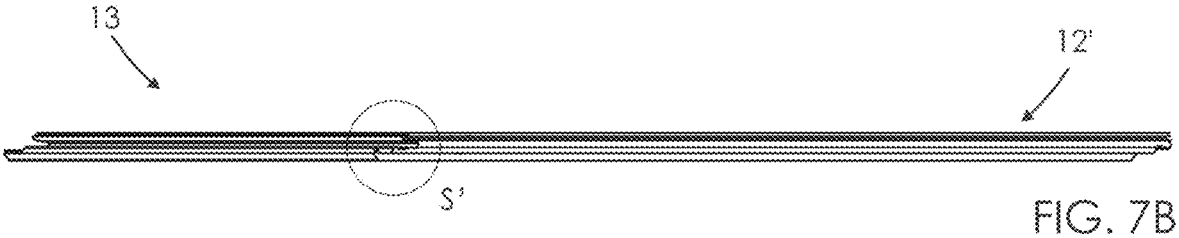
Figure 7C:
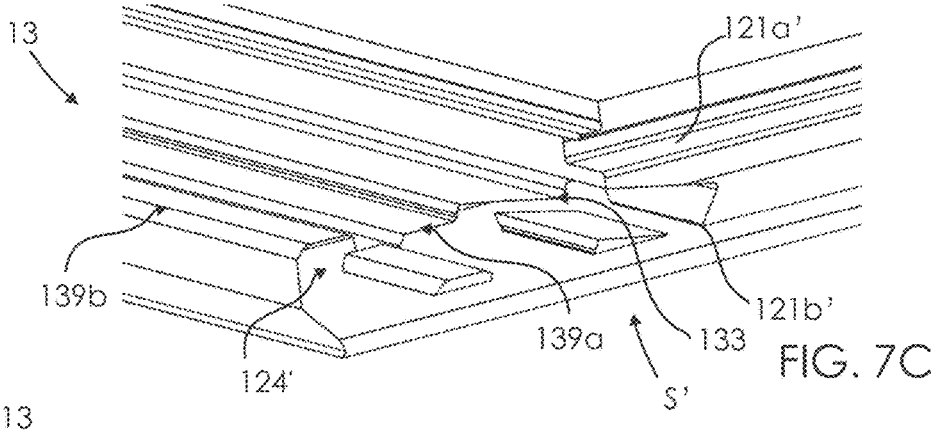
Figure 7D:
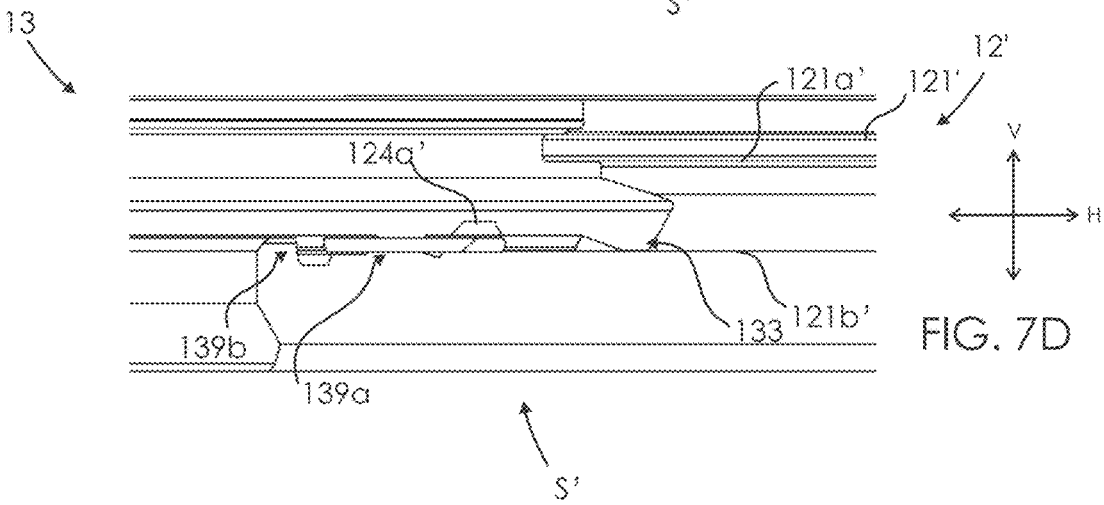

In some embodiments of the inventive concept, for example as illustrated in FIGS. 6A-6B, it is possible to combine the folding displacement with a sideward displacement, e.g. by sliding, where the sideward direction is substantially perpendicular to the folding direction. In an embodiment the sideward direction is the horizontal direction, and the folding direction is the vertical direction. In an embodiment the first building panel 1 is firstly arranged in contact with the second building panel 2, e.g. such that the mechanical locking device of the second edge 12 is connected or at least in contact with the mechanical locking device of the first edge 11 of the second building panel 2. Secondly, the first building panel 1 may then be displaced towards the third building panel 3, e.g. by sliding the first building panel 1 towards the third building panel 3 and simultaneously maintaining the contact with the second building panel 2. Thirdly, when e.g. the mechanical locking device of the fourth edge 14 of the first building panel 1 is in the right place to be connected to the mechanical locking device of the third edge 13 of the third building panel 3, the first building panel 1 is folded down into the assembled position, locked to the second and third building panel 2, 3. In another embodiment the first building panel 1 may firstly be arranged in contact with the second building panel and then folded downwards. Secondly, the first building panel may be sideward displaced towards the third building panel into the assembled position, locked to the second and third building panel.

It is advantageous to have a sideward displacement of the building panel during the assembly especially when the building panel have an oblong shape which otherwise may be quite ungainly to handle. It may be difficult to exactly positioned an oblong building panel before the folding displacement if it is not possible to firstly displace the building panel in a sideway direction. Further, when handling such oblong and sometimes quite heavy building panels elements of e.g. the mechanical locking device may break or damage if weight is applied wrongly.

FIG. 2A shows details of an exemplary first mechanical locking device 50'. The first mechanical locking device 50' is formed on respective first edges 11' and second edges 12' of the building panels 1', such as long edges, for horizontal and vertical locking of adjacent building panels by means of a folding F displacement. The second edges 12' comprises a locking tongue 121' configured to be received in a tongue groove 111' by means of the folding displacement, for vertical locking of the building panels.

FIG. 2B shows details of a second mechanical locking device 60 of a building panel 1 according to an embodiment. The second mechanical locking device 60 is formed on respective third 13 edges and fourth 14 edges of the building panels 1 according to the disclosure, such as short edges, for horizontal and vertical locking of adjacent building panels by means of a vertical displacement.

The second mechanical locking device 60 may comprise at one of the third or fourth edges 13, 14 a wedge groove 141 configured to receive and cooperate with a locking tongue, such as a displaceable locking tongue 131, see e.g. FIGS. 1B and 1C, of the other of the third or fourth edge 13, 14 for vertical locking of adjacent building panels in the assembled position. The displaceable locking tongue 131 may be a separate member and comprise the same or a different material than the panel. The displaceable locking tongue 131 may be made of a polymer-based material.

The displaceable locking tongue 131 may be configured to be displaced in and cooperate with an insertion groove 133 of the other of the third or fourth edge 13, 14. For purpose of more clearly convey the features of the building panel 1, the displaceable locking tongue 131 has been left out in FIGS. 2B, 3B, 4B, 5B and 6B.

The insertion groove 133 may be inclined vertically V downwards towards a back surface 16 of the building panel 1 or inclined upwards towards the front surface 15 of the building panel 1, in a direction into the insertion groove/towards the centre of the building panel 1. In the embodiments illustrated in FIGS. 3B, 4B, 5B, 6B and 17, the insertion groove 133 is inclined downwards, i.e. sloping towards the back surface 16.

In a non-limiting example, the locking devices 50', 50, 60 may be formed by feeding the building panel 1', 1 in a feeding direction past one or more cutting tools, such as a rotating cutting tool, whereby the one or more cutting tool may form at least one part of a locking device along one of the edges 11, 11', 12, 12', 13, 13', 14, 14'.

Consequently, the exemplary first locking device 50' and the second locking device 60 intersect at respective intersections S', T', U', V' of the building panel 1', as shown in FIGS. 7C-7D, 9C-9D, 11C-11D and 13C-13D, where S' is the intersection between the second edge 12' and the third edge 13', T' is the intersection between the second edge 12' and the fourth edge 14', U' is the intersection between the first edge 11', and the third edge 13', V' is the intersection between the first edge 11' and the fourth edge 14'.

However, as will be explained herein, the first and the second locking device 50', 60 intersecting does not necessarily follow that the features of the respective locking devices overlap.

Correspondingly, the first locking device 50, according to the inventive concept, and the second locking device 60 intersect at corresponding respective intersections S, T, U, V of the building panel 1, as shown in FIGS. 8C-8D, 10C-10D, 12C-12D, 14C-14D and 15C-15D, where S is the intersection between the second edge 12 and the third edge 13, T is the intersection between the second edge 12 and the fourth edge 14, U is the intersection between the first edge 11, and the third edge 13, V is the intersection between the first edge 11 and the fourth edge 14.

FIGS. 3A-3B, 4A-4B, 5A-5B and 6A-6B respectively show embodiments of a first mechanical locking device 50 and a second mechanical locking device 60 of a building panel 1 according to the inventive concept.

Immediately juxtaposed upper edge portions 118, 128 of the first edge 11 and second edge 12 may form, in the assembled position, a first vertical plane VP1. The first mechanical locking device 50 comprises a locking strip 112 projecting from the vertical plane VP1 at the first edge 11 in a direction away from the building panel 1. A locking element 113 is projecting from the locking strip 112 in a direction transverse or normal the locking strip 112.

The first mechanical locking device 50 further comprises, at the first edge 11, a sidewardly open tongue groove 111. The tongue groove 111 is inboard the locking strip 112 and the first vertical plane VP1. The tongue groove 111 is configured to receive and cooperate with a sidewardly protruding first locking tongue 121 of the second edge 12. A lower portion of the first locking tongue 121 comprising a lower surface 121*b* of the first locking tongue 121 is configured to be received in and cooperate with a cavity formed by the locking strip 112 between the locking element 113 and the tongue groove 111, for horizontal locking of adjacent building panels 1, 2 in a direction away from each other. The locking tongue 121 comprises an upper surface 121*a*, typically a locking surface, configured to cooperate with a corresponding opposite facing surface 111*a*, including a locking surface in the tongue groove 111, for vertical locking of adjacent building panels 1, 2. In any embodiment the lower surface 121*b* may be configured to cooperate with an upper surface 112*a* of the first locking strip 112.

The upper surfaces 121*a*, 111*a* may be substantially planar surfaces.

The second edge 12 comprises a locking groove 124 having an uppermost surface 124*a*, which in any embodiment may be the innermost surface of the locking groove 124, in the thickness direction of the building panel. The locking groove 124 is configured to receive and cooperate with the locking element 113 of the first edge 11 for the horizontal locking of adjacent building panels 1, 2 in a direction away from each other. Thus, one or more of the inner walls of the first locking groove 124 may cooperate with one or more surface of the first locking element 113 of an adjacent building panel, in assembled position of the building panels.

Immediately juxtaposed upper edge portions 138, 148 of the third edge 13 and fourth edge 14 may form, in the assembled position, a second vertical plane VP2. The second mechanical locking device 60 comprises a locking strip 139 projecting from the second vertical plane VP2. A locking element 139*b* projects from the locking strip 139 in a direction normal an upper surface 139*a* of the locking strip 139. The locking element 139*b* is configured to be received in a locking groove 145 of the fourth edge 14 of an adjacent building panel, for horizontal locking of the building panels from parting away from each other.

Figure 15:
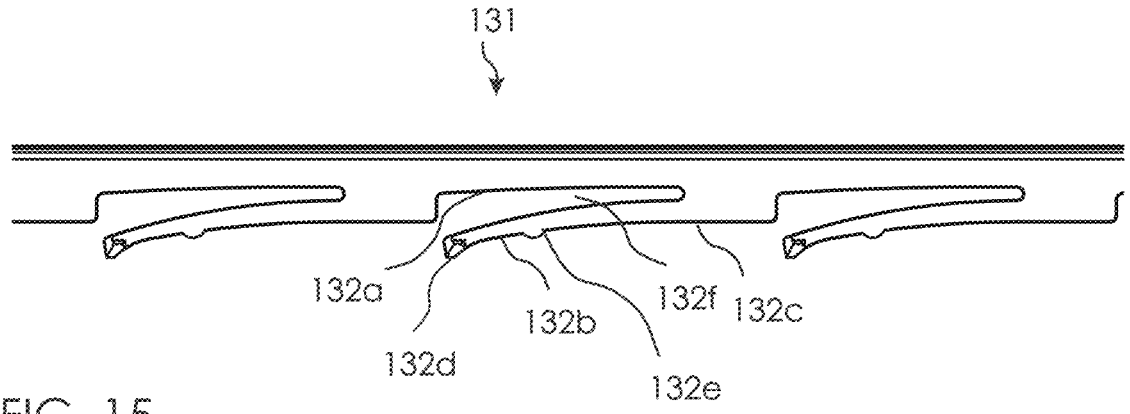
FIG. 15 illustrates a displaceable tongue, according to an embodiment, of a second mechanical locking device according to an embodiment of the inventive concept.

The second mechanical locking device 60 comprises at the third edge 13 a second locking tongue 131, such as a displaceable locking tongue 131, illustrated in e.g. FIGS. 1B and 15, configured to be displaced between a locking position and an unlocking position under the action of a vertical displacement VF of a fourth edge 14 of an adjacent building panel. The displaceable locking tongue 131 is configured to be displaced in the insertion groove 133, which may include a translating and/or linear displacement or a pivoting displacement to thereby cooperate with a corresponding wedge groove 141 of the fourth edge of the adjacent building panel, for vertical locking of the building panels.

FIG. 3B illustrates a second mechanical locking device 60 according to an embodiment of the inventive concept where the insertion groove 133 is sloping from an opening thereof towards the back surface with an angle of 10°.

FIG. 4B illustrates a second mechanical locking device 60 according to an embodiment of the inventive concept where the insertion groove 133 is sloping from an opening thereof towards the back surface with an angle of 5°, whereby an upper edge 141*a* of the opening 142 of the wedge groove 141 may be formed closer to the back surface as compared to the embodiment of FIG. 3B.

FIGS. 5A and 6A show embodiments wherein the locking tongue 121 of the first mechanical locking device 50 comprises a portion 122, at least partly sloping downwards towards the back surface 16 of the building panel 1. The sloping portion 122 extends from an outermost surface 121*c* of the locking tongue 121 down, in towards the rest of the building panel 1, to the lower surface 121*b* of the locking tongue 121. The downward sloping portion 122 may be a continuous sloping surface or divided into one or more surface sections 122*a*, 122*b* along the extension of the sloping portion 122. The extension in towards the rest of the building panel 1 of the sloping portion 122 illustrated in FIG. 6A is larger than the extension of the sloping portion 122 illustrated in FIG. 5A. As illustrated in FIG. 6A, the surface section 122*b* ending at the lower surface 121*b* of the locking tongue 121 starts above the plane M2, defined by the uppermost portion of the locking element 113 of the locking strip 112, for example at least 0.5 mm above the plane M2, or at least 1 mm above the plane M2. The embodiment of the first mechanical locking device 50 illustrated in FIG. 6A is especially beneficial if it is desirable to have an assembling of adjacent building panels 1, 2, 3 including both a folding displacement and a sideward displacement as described above.

In every embodiment of the first mechanical locking device 50 illustrated in FIGS. 3A, 4A, 5A and 6A the height H of the locking tongue 121, between the uppermost surface 121*a* and the lowermost surface 121*b* in the direction perpendicular to the front surface 15, is configured to at least partly accommodate parts of the second mechanical locking device 60. For example, the height H of the locking tongue 121, between the uppermost surface 121*a* and the lowermost surface 121*b* in the direction perpendicular to the front surface 15, is configured to accommodate the insertion groove 133, the displaceable locking tongue 131, the wedge groove 141, the upper surface 139*a* of the locking strip (139) and/or at least an upper portion of the locking element 139*b*. In a preferred embodiment the height H of the locking tongue 121, between the uppermost surface 121*a* and the lowermost surface 121*b* in the direction perpendicular to the front surface 15, is configured to accommodate all of the insertion groove 133, the displaceable locking tongue 131, the wedge groove 141, the upper surface 139*a* of the locking strip (139) and at least an upper portion of the locking element 139*b*

As illustrated in FIGS. 2A-2B the exemplary first mechanical locking device 50' and its extent in the vertical, or normal direction is compared with the extent in the same direction of the second mechanical locking device 60. The reference planes L1-L2 and M1'-M3' are described in more detail below. However, plane M3' extends parallel to the front surface 15 of the building panel 1 and through the lowermost surface 121*b'* of the locking tongue 121 of the exemplary first mechanical locking device 50'. Following plane M3' to the second mechanical locking device 60 it intersects with the insertion groove 133, at least with the lowermost part of the insertion groove 133 closest to the back surface 16 of the building panel 1. This means that during a manufacturing process of the building panel 1, when forming the intersection S', explained in more detail below, between the second edge 12' having the exemplary first mechanical locking device 50' and the third edge 13 having the second mechanical locking device 60, the forming of the insertion groove 133, and at least the lowermost part of the insertion groove 133 will affect and cut at least partly through the locking tongue 121' of the exemplary first mechanical locking device 50'. This will in turn create at least one undesirable gap between the exemplary first mechanical locking device 50' and the second mechanical locking device 60 when assembling two adjacent building panels 1, 2, 3. The same applies for the upper surface 139*a* of the locking strip 139 of the second mechanical locking device 60 visualized by the upper surface 139*a* being situated vertically, or in the normal direction, below the plane M3'. Thus, during the manufacturing process of the building panel 1, when forming the intersection S', the forming of the upper surface 139*a* of the locking strip 139 will affect and cut at least partly through the locking tongue 121' of the exemplary first mechanical locking device 50', creating at least one undesirable gap between the exemplary first mechanical locking device 50' and the second mechanical locking device 60 when assembling two adjacent building panels 1, 2, 3.

As derivable from FIGS. 3A-3B, 4A-4B, 5A-5B and 6A-6B the vertical V extent of the second locking device 60 may subsist within the vertical extent of the first locking tongue 121, such as the sideways projecting portion thereof, which in any embodiment may include a portion of the first locking tongue 121 projecting from the first vertical plan VP1 at the second edge 12.

In particular, the vertical distance between the upper edge 135*a* of the insertion groove 133 and the upper surface 139*a* of the locking strip 139 of the second locking device 60 subsists within the vertical distance between the upper surface 121*a* and the lower surface 121*b* of the locking tongue 121 of the first locking device 50.

In particular, the vertical distance between the upper edge 135*a* of the insertion groove 133 and the upper surface 139*a* of the locking strip 139 of the second locking device 60 subsists within the vertical distance between the upper surface 121*a* and the uppermost and/or innermost surface 124*a* of the locking groove 124 of the first locking device 50.

Comparing the embodiments illustrated in FIGS. 3A-3B, 4A-4B, 5A-5B and 6A-6B with the exemplary embodiment illustrated in FIGS. 2A-2B it can be seen that forming of the insertion groove 133 and the upper surface 139*a* of the locking strip 139 of the second mechanical locking device 60 will not have the same effect on the locking tongue 121 of the first mechanical locking device 50 compared to the locking tongue 121' of the exemplary first mechanical locking device 50'. Illustrated by the plane M3, extending parallel with the front surface 15 and through the lower surface 121*b* of the locking strip 121 of the first mechanical locking device 50, it extends and intersects with the locking strip 139 of the second mechanical locking device 60. In more detail plane M3 intersects with the locking strip 139 of the second mechanical locking device 60 vertically, or in the normal direction, below both the lowermost part of the insertion groove 133 and the upper surface 139*a* of the locking strip 139. Thus, when forming the intersection S, explained in more detail below, between the second edge 12 having the first mechanical locking device 50, according to the inventive concept, and the third edge 13 having the second mechanical locking device 60, the forming of the insertion groove 133, and at least the lowermost part of the insertion groove 133, and the upper surface 139*a* of the locking strip of the second mechanical locking device 60 will not cut through the entire locking tongue 121 of the first mechanical locking device 50. It will in turn not create the undesirable gaps between the first mechanical locking device 50 and the second mechanical locking device 60 when assembling two adjacent building panels 1, 2, 3.

It should be appreciated that any one of the embodiments shown in FIGS. 2B and 3B may be combined with any of the embodiment shown in FIG. 3A, 4A, 5A or 6A. It should be appreciated that any one of the embodiments shown in FIG. 4B, 5B or 6B may be combined with any of the embodiments shown if FIGS. 2B and 3B.

In FIGS. 2A-2B, 3A-3B, 4A-4B, 5A-5B, 6A-6B and 16-32, schematic planes L1-M3 have been added for ease of reference.

Referring to FIGS. 2A-2B, 3A-3B, 4A-4B, 5A-5B, 6A-6B and 16-32 a plane L1 extends in the front surface 15 of the building panels and a plane L2 extends in the back surface 16 of the building panels in an assembled position. These planes L1, L2 may be the reference planes in all embodiments illustrated in FIGS. 2A-6B. The normal direction of L1 and/or L2 may be parallel to the vertical direction when the building panels are assembled as a flooring system and may be parallel to the horizontal direction when the building panels are assembled as a wall system.

Referring to FIGS. 2A-2B, plane M1' extends parallel to plane L1 and through the upper surface 121*a'* of the locking tongue 121' of the exemplary first mechanical locking device 50'. Further, plane M1' extends through the upper surface 111*a'* of the tongue groove 111' of the exemplary first mechanical locking device 50'.

Plane M2' is positioned vertically, or in the normal direction, below M1' extends parallel to plane L1 and through the upper surface 124*a'* of the locking groove 124' of the exemplary first mechanical locking device 50'. Further, plane M2' is positioned vertically, or in the normal direction, above the upper surface 139*a* of the locking strip 139 of the second mechanical locking device 60.

The insertion groove 133 extends vertically, or in the normal direction, below plane M2'.

Plane M3' extends parallel to plane L1 and through the lower surface 121*b'* of the locking tongue 121' of the exemplary first mechanical locking device 50'. Further, plane M3' is provided vertically, or in the normal direction, above the upper surface 139*a* of the locking strip 139 of the second mechanical locking device 60.

Planes M1', M2' and M3' are displaced in the normal direction of L1 and/or L2.

Referring to FIGS. 3A-3B, 4A-4B, 5A-5B, 6A-6B and 16-232, planes M1, M2 and M3 illustrated in those figures extend parallel to L1 and/or L2. Planes M1, M2 and M3 are displaced in the normal direction of L1 and/or L2.

The first plane M1 extends parallel to plane L1, i.e. parallel to the front surface 15, and through the upper surface 121*a* of the locking tongue 121 of the first mechanical locking device 50. Preferably, plane M1 extends through a lowermost portion or point of the upper surface 121*a* of the locking tongue 121 of the first mechanical locking device 50.

Further, plane M1 is preferably provided vertically V, or in the normal direction, at or above the upper edge 141*a* of the opening 142 of the wedge groove 141*a* of the second mechanical locking device 60.

Plane M1 is preferably provided in the normal direction above the upper edge 135*a* of the opening of the insertion groove 133 of the second mechanical locking device 60.

Further, plane M1 may extend through the upper surface 111*a* of the tongue groove 111 of the first mechanical locking device 50. Preferably, plane M1 extends through a lowermost portion or point of the upper surface 111*a* of the tongue groove 111 of the first mechanical locking device 50.

Yet further, the upper surface 121*a* of the locking tongue 121 and the upper surface 111*a* of the tongue groove of the first mechanical locking device 50, may in the assembled position form plane M1.

The second plane M2 is positioned vertically, or in the normal direction, below plane M1 and extends parallel to plane L1 and through the upper surface 124*a* of the locking groove 124 of the first mechanical locking device 50, and preferably through an uppermost portion or point of the upper surface 124*a*.

Plane M2 is positioned vertically, or in the normal direction, below the upper surface 139*a* of the locking strip 139 of the second mechanical locking device 60, preferably vertically V, or in the normal direction, below a lowermost portion of the upper surface 139*a*.

The insertion groove 133 may preferably not extend vertically V, or in the normal direction, below plane M2.

The third plane M3 is positioned vertically, or in the normal direction, below plane M1 and M2 and extends parallel to plane L1 and through the lower surface 121*b* of the locking tongue 121 of the first mechanical locking device 50.

The lower surface 121*b* of the locking tongue 121 and the upper surface 112*a* of the locking strip 112 of the first mechanical locking device 50 may in the assembled position form the plane M3.

In any embodiment, the locking element 113 of the locking strip 112 of the first mechanical locking device 50 may project vertically V, or in the normal direction, upwards from the third plane M3.

The upper surface 112*a* extends preferably between the tongue groove 111 and the locking element 113.

The insertion groove 133 may preferably not extend vertically, or in the normal direction, below M3, preferably a lowermost portion of the insertion groove 133 is positioned vertically V, or in the normal direction, above the third plane M3.

In any embodiment, the locking element 113 of the first mechanical locking device 50 projects vertically V upwards from the third plane M3.

In an embodiment the plane M3 extends between an upper side and a lower side of the locking strip 139. Preferably, a lowermost point of the upper side of the locking strip 139 is arranged above the plane M3 in a direction perpendicular to the front surface 15.

In an embodiment a lowermost point of the upper surface 139*a* of the locking strip 139 is arranged above the plane M3 in a direction perpendicular to the front surface 15.

In an embodiment a lowermost point of the insertion groove 133 is arranged above the plane M3 in a direction perpendicular to the front surface 15.

In any embodiment, planes M1, M2 and M3 may be horizontal planes if the building panel is assembled as a flooring system and vertical planes if the building panel is assembled as a wall system.

In any embodiment, the extension of the upper and lower surfaces 121*a* and/or 121*b* of the locking tongue 121 may be substantially horizontal if the building panel is assembled as a flooring system and substantially vertical if the building panel is assembled as a wall system.

In any embodiment, the extension of the upper and lower surfaces 111*a* and/or 111*b* of the tongue groove 111 may be substantially horizontal if the building panel is assembled as a flooring system and substantially vertical if the building panel is assembled as a wall system.

In any embodiment, the extension of the upper surface 139*a* of the locking strip 139 may be substantially horizontal if the building panel is assembled as a flooring system and substantially vertical if the building panel is assembled as a wall system.

In any embodiment, the extension of the upper surface 124*a* of the locking groove 124 may be substantially horizontal if the building panel is assembled as a flooring system and substantially vertical if the building panel is assembled as a wall system.

In any embodiment, the locking surfaces 145*c*, 139*c*, as illustrated in e.g. FIGS. 18-21, which are configured to cooperate for horizontal locking of two adjacent building panels and preventing them from parting away from each other in a direction perpendicular the third edge 13 and fourth edge 14 may be provided in the normal direction above the third plane M3, preferably above the second plane M2.

FIGS. 16-32 show a first mechanical locking device 50 according to an embodiment and several embodiments of a second mechanical locking device 60. FIGS. 24-32 only show embodiments of the second mechanical locking device 60. However, planes M1-M3, although defined by features of the first mechanical locking device 50 are nevertheless schematically shown in FIGS. 24-32.

Returning again to the formation of the mechanical locking devices and the intersections between them, i.e. in the corners of the building panel 1, 2, 3 were the first mechanical locking device 50, 50' meets the second mechanical locking device 60 in a substantially perpendicular intersection.

FIGS. 7A-7D show details of the intersection S' between the second edge 12' and the third edge 13, in an exemplary building panel 1' provided with the exemplary first locking device 50'. As derivable from FIG. 7C the formation of the insertion groove 133 cuts through the locking tongue 121' of the first mechanical locking device 50' over a vertical distance, or distance in the normal direction, which reaches below the lower surface 121*b*' of the locking tongue 121', whereby the lower surface 121*b*' does not overlap a major portion of the insertion groove 133 at intersection S'. Thereby, the lower surface 121*b*' cannot properly seal against the locking strip 112' of the first mechanical locking device 50' of an adjacent building panel at the intersection S', in the assembled position of the building panels.

Further, the formation of the locking strip 139 of the second mechanical locking device 60 cuts through the locking tongue 121' of the first mechanical locking device 50' over a vertical distance, or a distance in the normal direction, which reaches below the lower surface 121*b*' of the locking tongue 121', whereby the lower surface 121*b*' does not overlap the locking strip 139 of the second mechanical locking device 60 at the intersection S'. Thereby, the lower surface 121*b*' cannot properly seal against the locking strip 112' of the first mechanical locking device 50' of an adjacent building panel at the intersection S', in the assembled position of the building panels.

FIGS. 8A-D show details of the intersection S between the second edge 12 and the third edge 13 of a building panel according to an embodiment of the present disclosure and the inventive concept.

The vertical extent, or the extent in the normal direction, of the locking tongue 121 of the first mechanical locking device 50 is configured to accommodate the formation of the second mechanical locking device 60 of the adjacent edge, such as the third edge 13 and/or fourth edge 14, within the vertical V extent, or extent in the normal direction.

In particular, the vertical extent, or the extent in the normal direction, of the locking tongue 121 of the first mechanical locking device 50 is configured to accommodate the formation of the insertion groove 133 of the second mechanical locking device 60, and more preferably accommodate the entire insertion groove 133 within the vertical extent, or extent in the normal direction, of the locking tongue 121.

More in particular, the vertical extent, or the extent in the normal direction, of the locking tongue 121 of the first mechanical locking device 50 is configured to accommodate the formation of the locking strip 139 of the second mechanical locking device 60, and preferably accommodate the entire insertion groove 133 and the locking strip 139 of the second mechanical locking device 60 within the vertical extent, or the extent in the normal direction, of the locking tongue 121.

In a preferred embodiment shown in FIGS. 8A-D, the vertical extent, or the extent in the normal direction, of the locking tongue 121 of the first mechanical locking device 50 is configured to accommodate the formation of the insertion groove 133 of the second mechanical locking device 60, and preferably accommodate the entire insertion groove 133 and at least partly the locking strip 139 of the second mechanical locking device 60 including the upper surface 139*a* and the locking element 139*b* of the locking strip 139 of the second mechanical locking device 60.

The lower surface 121*b* of locking tongue 121 of the first mechanical locking device 50 is thus vertically positioned, or displaced in the normal direction, below the insertion groove 133. Thereby, the vertical extent, or the extent in the normal direction, of the locking tongue 121 of the first mechanical locking device 50 is increased compared to the exemplary first mechanical locking device 50' illustrated in FIG. 2A and FIGS. 7A-D. Put differently, the vertical distance, or the distance in the normal direction, between the upper surface 121*a* and the lower surface 121*b* of the locking tongue 121 of the first mechanical locking device 50 is increased.

By providing or forming the lower surface 121*b* of the locking tongue 121 vertically V, or in the normal direction below the insertion groove 133, the lower surface 121*b* may continuously overlap the insertion groove 133 at the intersection S between second edge 12 and third edge 13. Thereby, the lower surface 121*b* of the locking tongue 121 is able to seal against the upper surface 112*a* of the locking strip 112 of the first mechanical locking device 50 at the first edge 11 of an adjacent building panel 2, at the intersection S between the second edge 12 and third edge 13, when assembling the building panels 1, 2 and maintain that seal in the assembled position of the building panels 1, 2. An advantage with that is that this decreases the risk of fluid, coming from the front surface 15, of migrating further into the building panel. Preferably fluid trying to migrate into the building panel reaching the insertion groove 133 may not go further.

The lower surface 121*b* of the locking tongue 121 of the first mechanical locking device 50 may thus be vertically positioned, or displaced in the normal direction, below the upper surface 139*a* of locking strip 139 of the second mechanical locking device 60 at the third edge 13 of the building panel.

By providing or forming the lower surface 121*b* of locking tongue 121 vertically V, or in the normal direction below the upper surface 139*a* of the locking strip 139 at the third edge 13, the lower surface 121*b* may continuously overlap the upper surface 139*a* of locking strip 139 of the second mechanical locking device 60 at the third edge 13 at the intersection S between second edge 12 and third edge 13. Thereby, the lower surface 121*b* of the locking tongue 121 is able to seal against the upper surface 112*a* of the locking strip 112 of the first mechanical locking device 50 at the first edge 11 of an adjacent building panel 2, at the intersection S between the second edge 12 and the third edge 13, when assembling the building panels 1, 2 and maintain that seal in the assembled position of the building panels 1, 2.

Figure 8A:
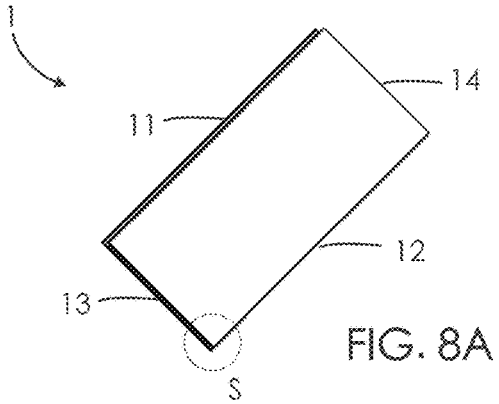
FIGS. 8A-8D show a building panel comprising a first mechanical locking device, according to an embodiment of the inventive concept.
Figure 8B:
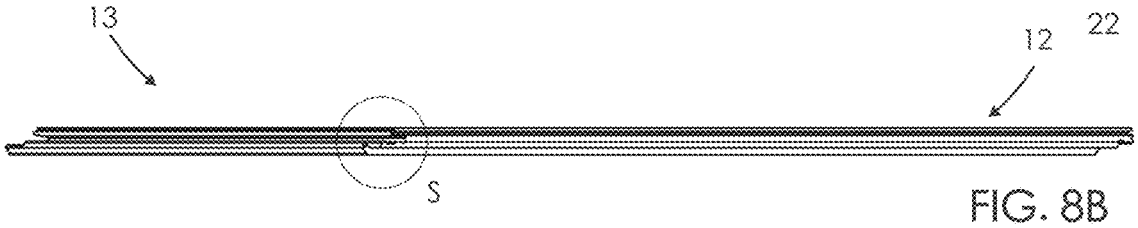
Figure 8C:
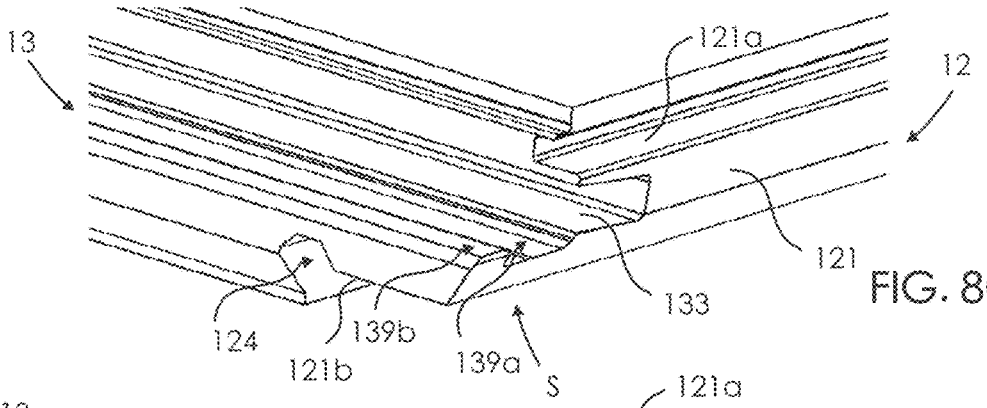
Figure 8D:
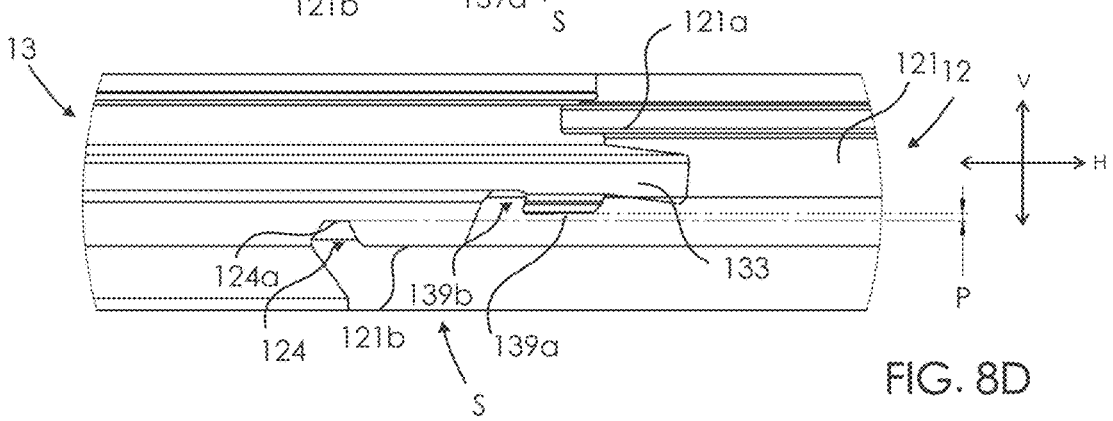

As derivable from FIG. 8C, the upper surface 139*a* and the locking element 139*b* of the second mechanical locking device 60 at the third edge 13 continuously overlap the locking groove 124 of the first mechanical locking device 50 at the intersection S. Also, the upper surface 139*a* and the locking element 139*b* of the second mechanical locking device 60 at the third edge 13 continuously overlap the lower surface 121*b* of the locking tongue 121 of the first mechanical locking device 50 at the intersection S. This decreases the risk of fluid migrating further into the building panel and preferably fluid trying to migrate into the building panel reaching the upper surface 139*a* may not go further, entering the locking groove 124 of the first mechanical locking device 50.

Further, curtesy of the continuous extension of the upper surface 139*a* at the intersection S, the upper surface 139*a* may thus seal against a lower edge surface 143*b* of a lower edge portion 143 at the fourth edge 14 of an adjacent building panel, when assembling the building panels and maintain that seal in the assembled position of the building panels.

Further, curtesy of the continuous extension of the locking element 139*b* of the second mechanical locking device 60 at the intersection S, the locking element 139*b* may thus seal against the locking groove 145 of the second mechanical locking device 60 at the fourth edge 14 of an adjacent building panel, when assembling the building panels and maintain that seal in the assembled position of the building panels.

By providing or forming the lower surface 121*b* of the locking tongue 121 vertically V, or in the normal direction below the upper surface 139*a* of locking strip 139 of the second mechanical locking device 60 at the third edge 13, the upper surface 139*a* may continuously overlap the first mechanical locking device 50 at the second edge 12 at the intersection S, whereby the resistance to fluid penetration through the second mechanical locking device 60 is improved.

In any embodiment, by configuring and/or forming the insertion groove 133 at the third edge 13 with a smaller slope from the opening thereof and towards the back surface 16, such as less than 10°, such as 1° to 10°, preferably less than 7°, more preferably about 5°, the vertical V distance P, or the distance P in the normal direction, between the upper surface 139*a* of the locking strip 139 of the second mechanical locking device 60 and the upper surface 124*a* of the locking groove 124 of the first mechanical locking device 50 at the second edge 12 at the intersection S between the second edge 12 and the third edge 13 is increased. Thus, the tolerance between the upper surface 139*a* of the locking strip 139 of the second mechanical locking device 60 and the upper surface 124*a* of the locking groove 124 of the first mechanical locking device 50 at the second edge 12 at the intersection S is improved.

In any embodiment, the insertion groove 133 may be designed to have no slope, i.e. to be arranged at about 0° and substantially parallel to the front and/or back surface 15, 16 of the building panel 1.

FIGS. 9A-9D show details of the intersection T' between the second edge 12' and the fourth edge 14 of the exemplary building panel 1', provided with the exemplary first locking device 50'.

Figure 9A:
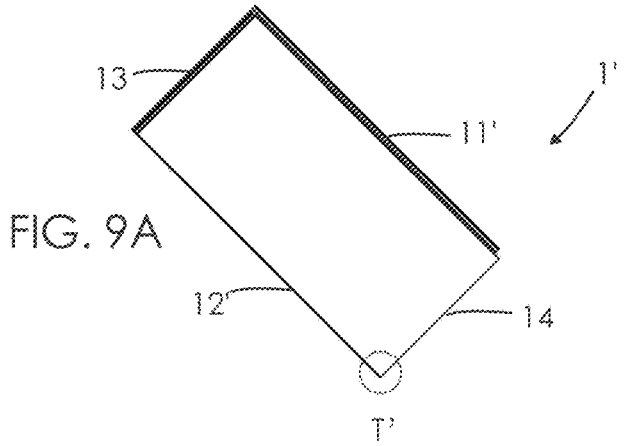
FIGS. 9A-9D show the exemplary building panel of FIGS. 7A-7D comprising the exemplary first locking device.
Figure 9B:
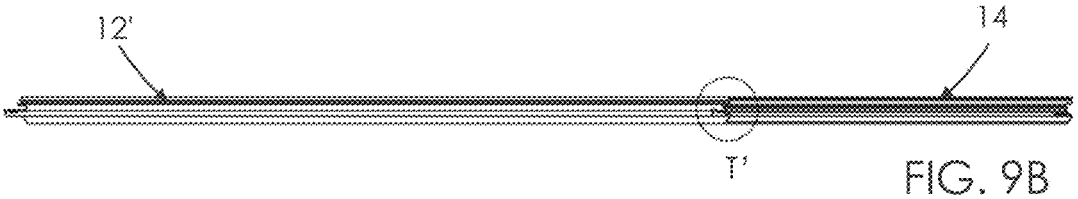
Figure 9C:
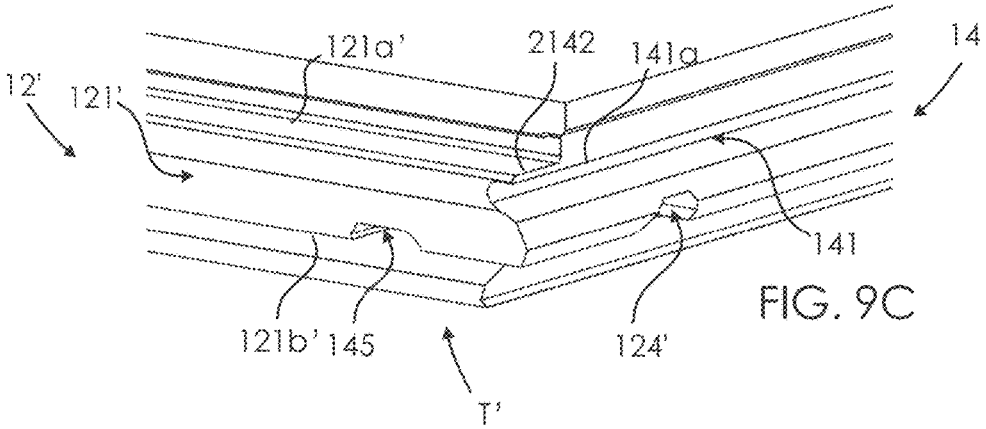
Figure 9D:
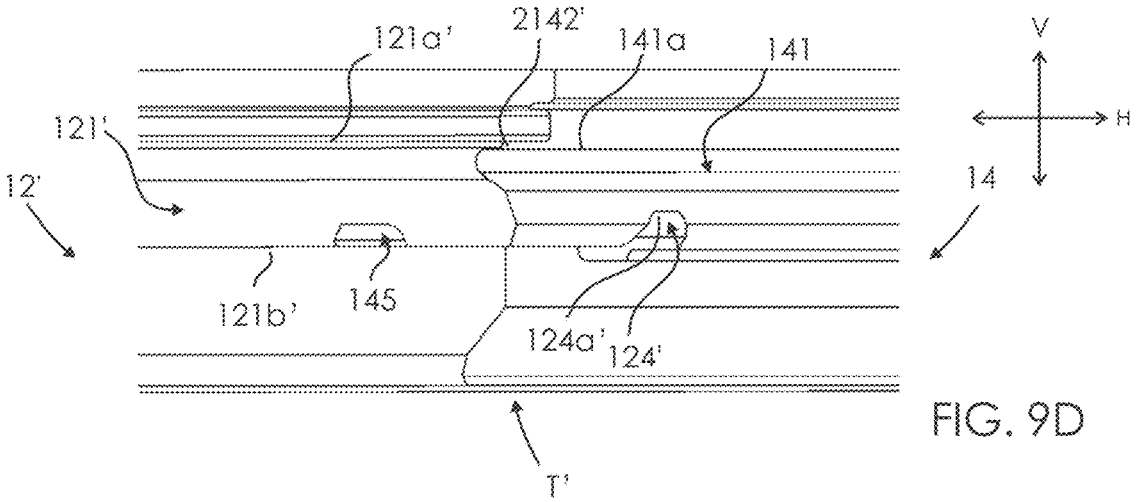
Figure 10A:
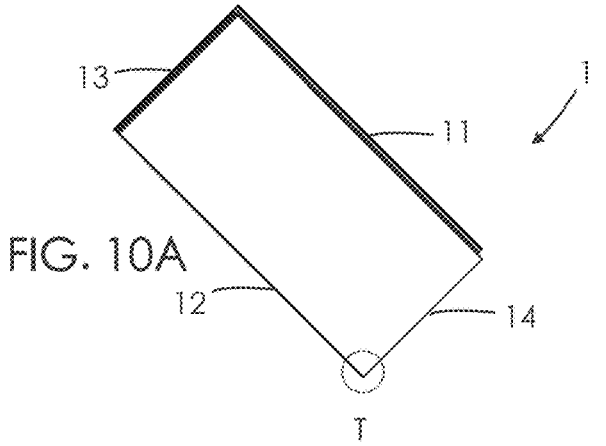
FIGS. 10A-10D show the building panel comprising the first mechanical locking device, according to the embodiment of FIGS. 8A-8D.
Figure 10B:
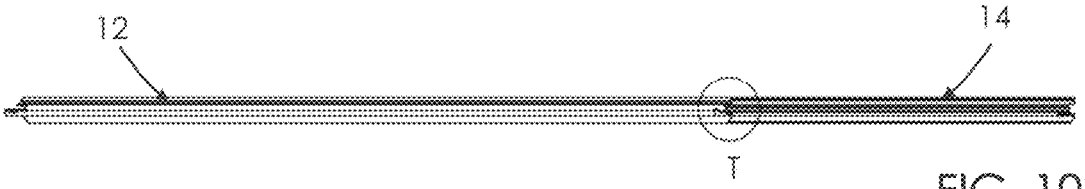
Figure 10C:
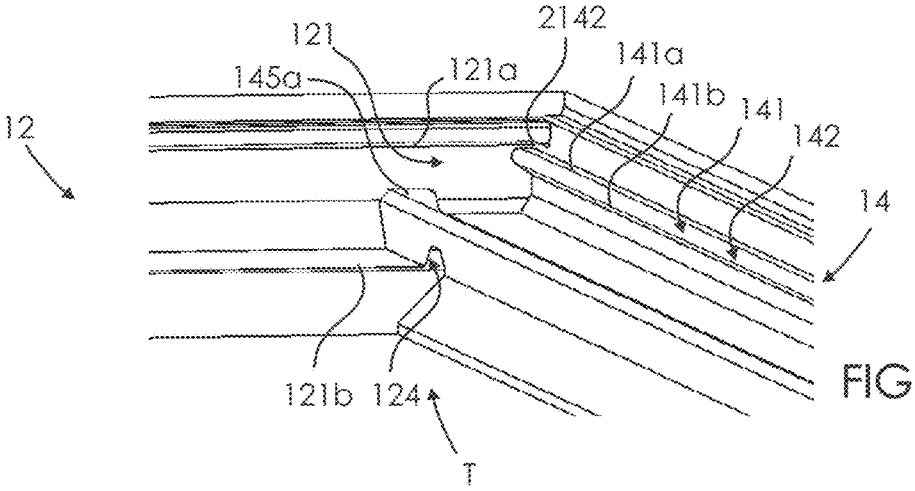
Figure 10D:
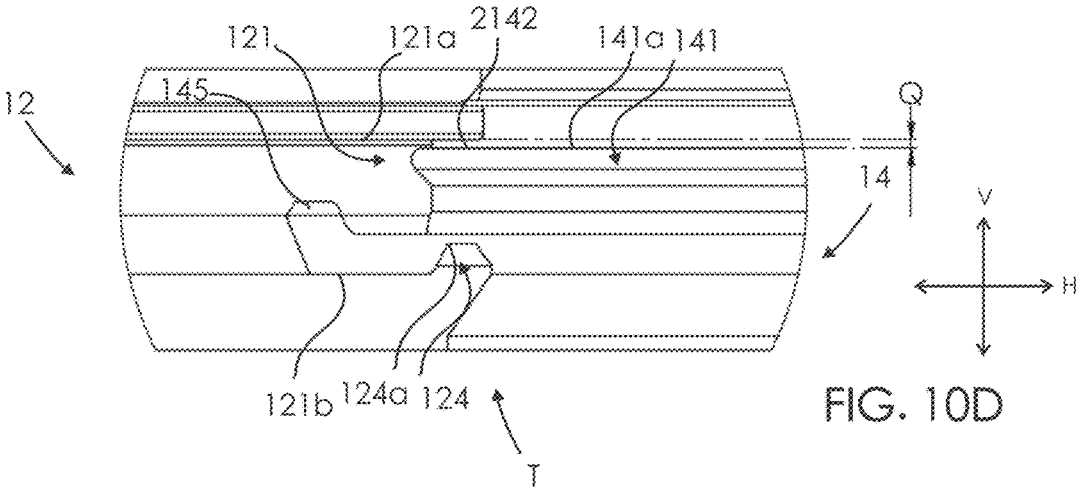

As derivable from FIG. 9C, an issue with the exemplary building panel 1' is that the vertical distance, or the distance in the normal direction, between the upper edge 141*a* of the wedge groove 141 of the second locking device 60 at the fourth edge 14 and the upper surface 121*a'* of the locking tongue 121' is rather small, whereby the portion 2142 between upper surface 121*a'* and the wedge groove 141 at the intersection T' may be weak and prone to break. Another issue may be that the manufacturing tolerances may have to be sufficiently small in order to form the portion 2142. For example, should the precision of the manufacturing process, which may be milling, be not suffice, the consequence may be that forming the wedge groove 141 infringes the plane of the upper surface 121*a'* of the locking tongue 121' and thus fluid may migrate from the upper surface 121*a'* to the wedge groove 141' and further down in the locking devices 50, 60 at the intersection T'.

FIGS. 10A-D show details of the intersection T between the second edge 12 and the fourth edge 14 of a building panel 1 according to an embodiment of the present disclosure and the inventive concept.

In any embodiment, by configuring and/or forming the insertion groove 133 at the third edge 13 with a smaller slope from the opening thereof and towards the back surface 16, such as less than 10°, preferably less than 7°, more preferably about 5°, the vertical V distance Q or the distance Q in the normal direction, between the upper edge 141*a* of the opening 142 of the wedge groove 141 at the fourth edge 14 and the upper surface 121*a* of the locking tongue 121 of the first mechanical locking device 50 at the second edge 12 may be increased, so that the upper edge 141*a* may be provided and/or formed at a vertically lower position. Thereby, the tolerance between the upper edge 141*a* of the opening 142 of the wedge groove 141 at the fourth edge 14 and the upper surface 121*a* of the locking tongue 121 at the second edge 12 is increased.

Thereby, also more material is provided between wedge groove 141 and the upper surface 121*a* of locking tongue 121 at the intersection T between the second edge 12 and the fourth edge 14, thereby the portion 2142 may be made stronger and more rigid.

FIGS. 11A-11D show details of the intersection U' between the first edge 11' and the third edge 13 of the exemplary building panel 1', provided with the exemplary first mechanical locking device 50'.

Figure 11A:
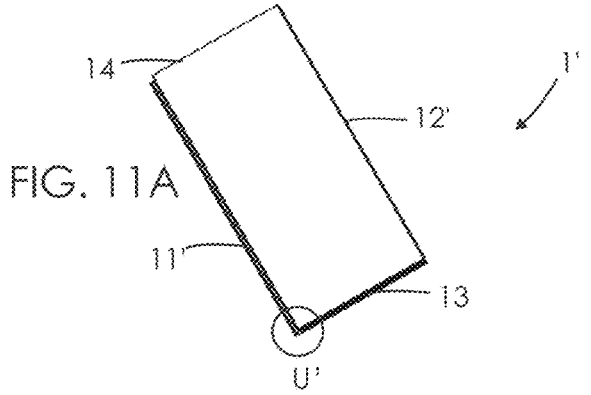
FIGS. 11A-11D show the exemplary building panel of FIGS. 7A-7D comprising the exemplary first locking device.
Figure 11B:
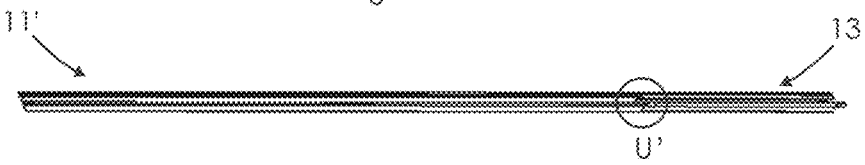
Figure 11C:
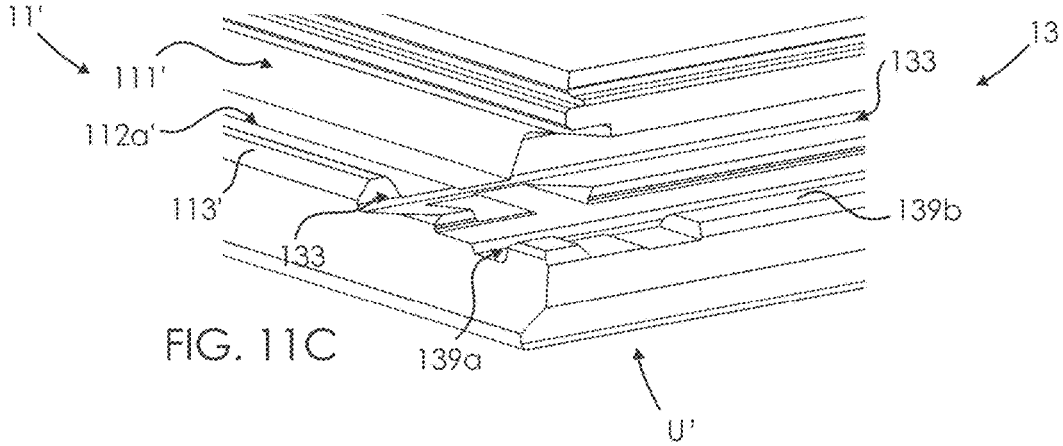
Figure 11D:
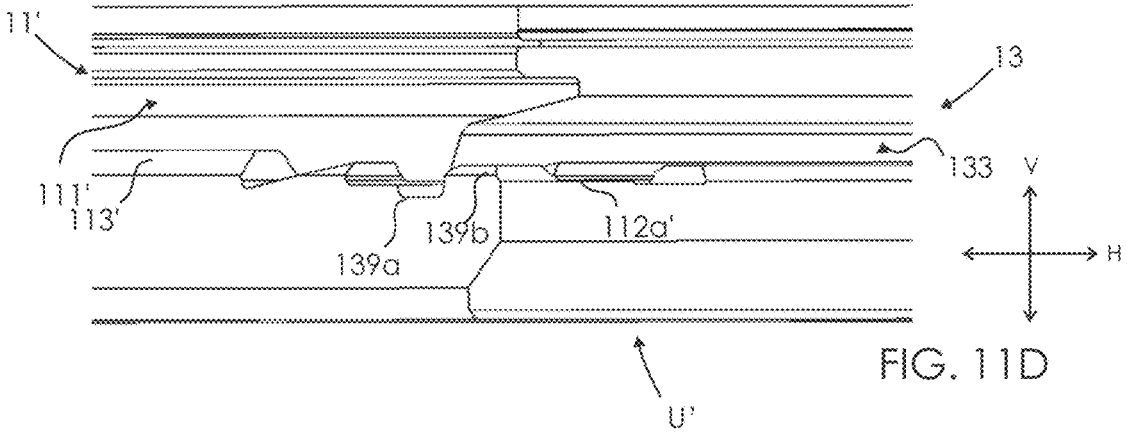
Figure 12A:
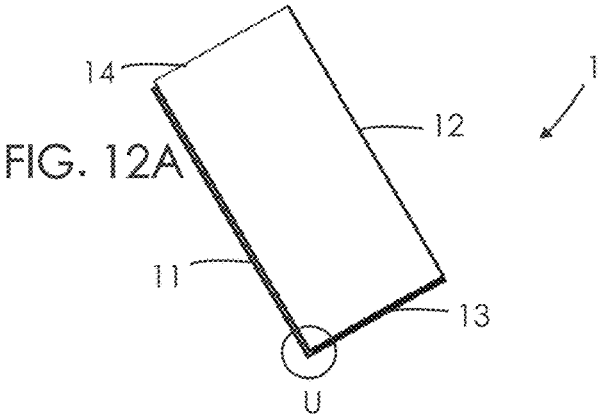
FIGS. 12A-12D show the building panel comprising a first mechanical locking device, according to the embodiment of FIGS. 8A-8D.
Figure 12B:
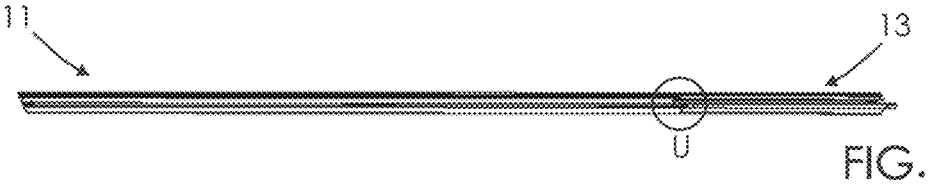
Figure 12C:
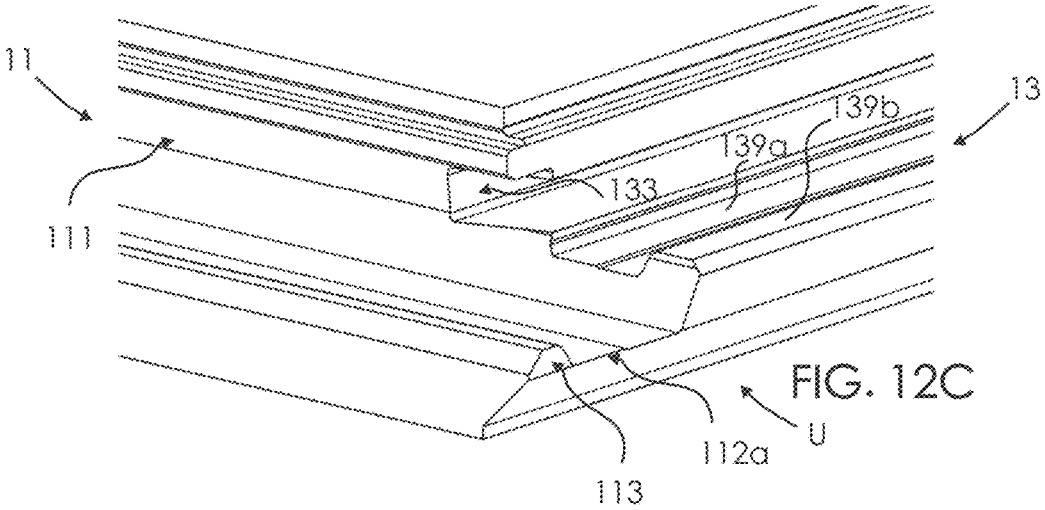
Figure 12D:
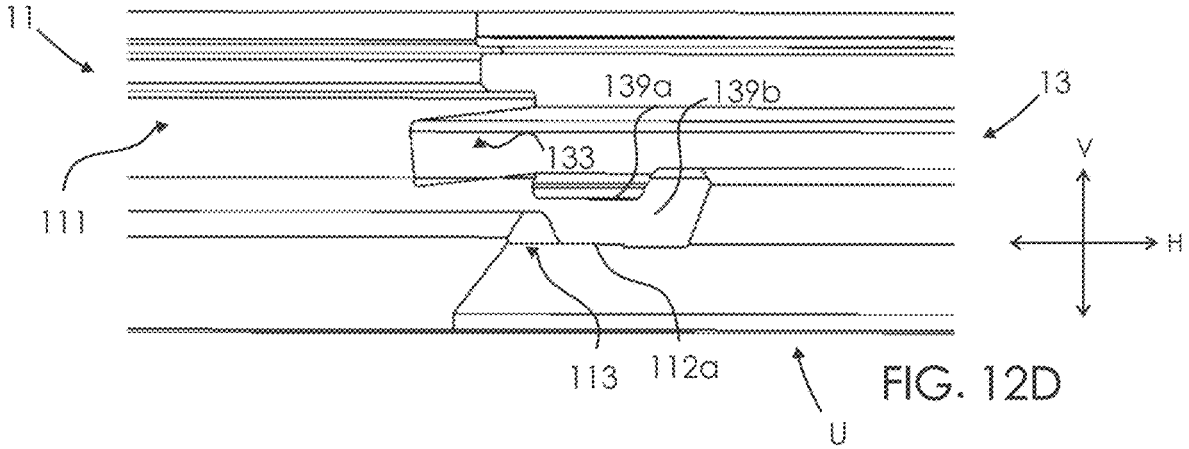
Figure 13A:
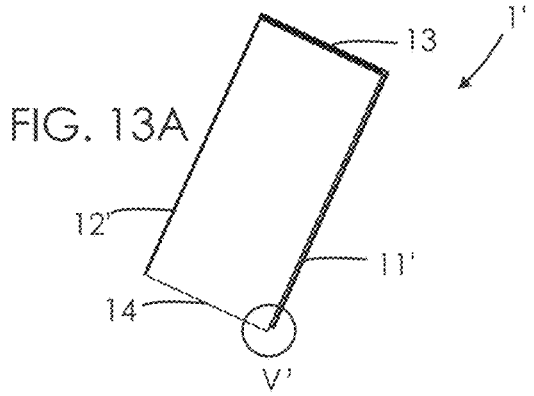
FIGS. 13A-13D show the exemplary building panel of FIGS. 7A-7D comprising the exemplary first locking device.
Figure 13B:
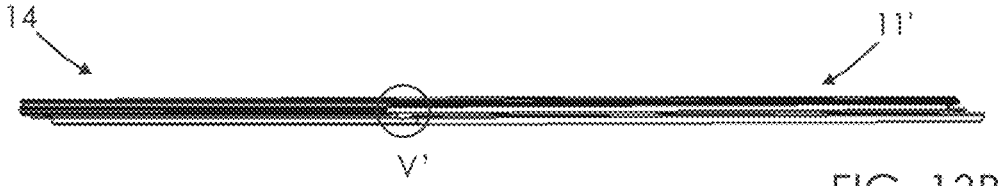
Figure 13C:
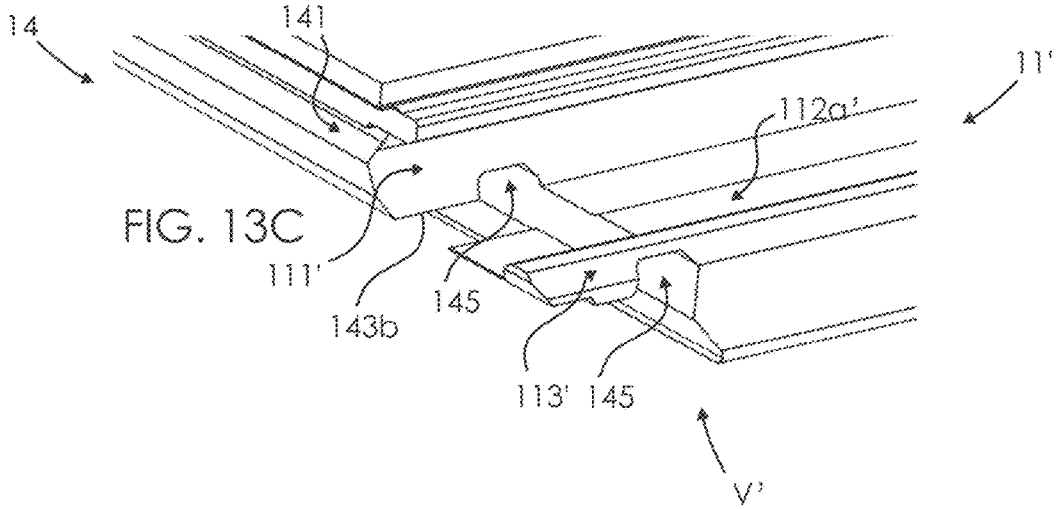
Figure 13D:
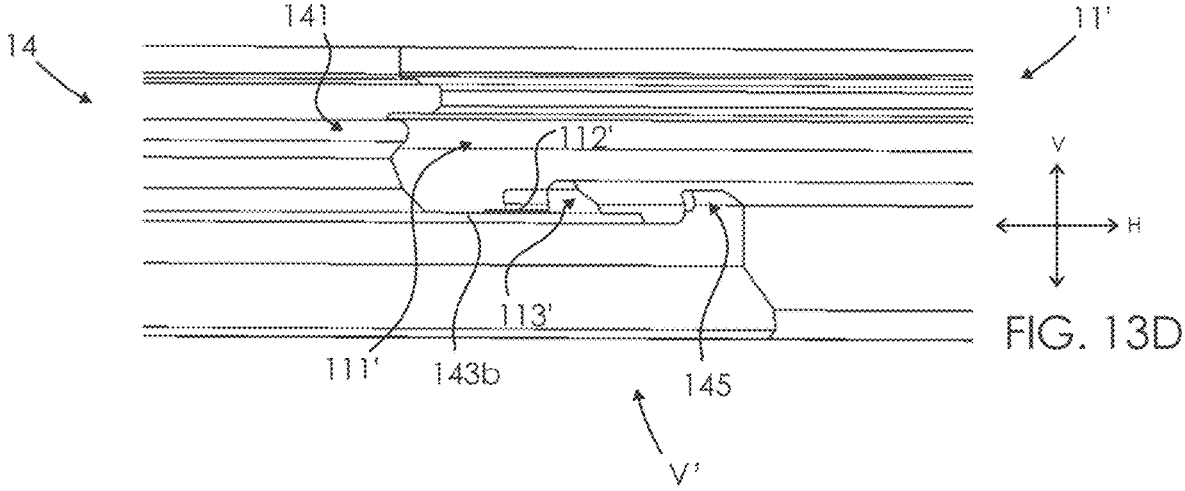
Figure 14A:
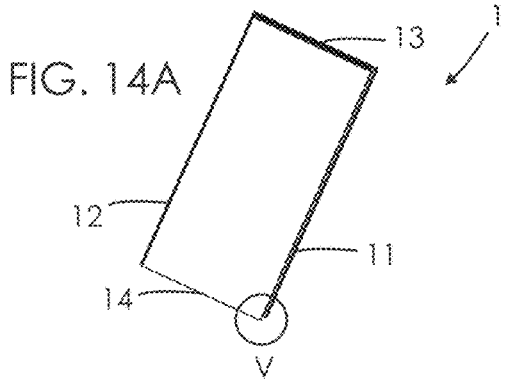
FIGS. 14A-14D show the building panel comprising a first mechanical locking device, according to the embodiment of FIGS. 8A-8D.
Figure 14B:
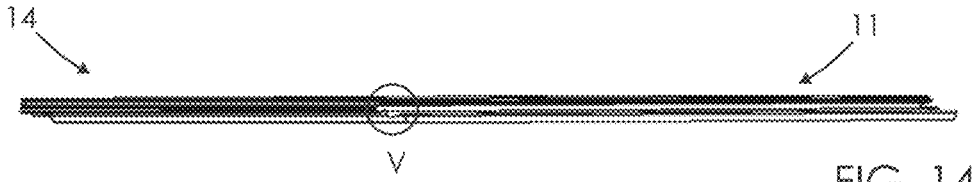
Figure 14C:
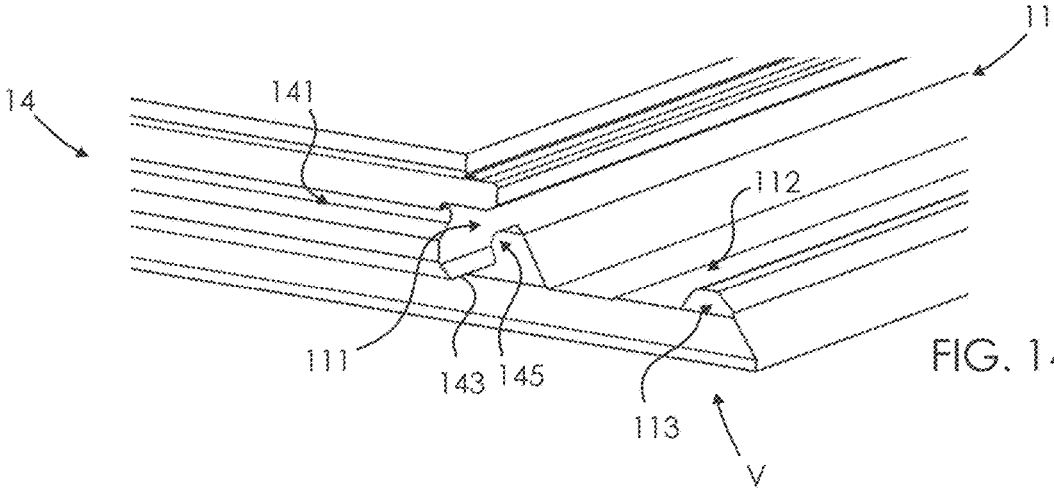
Figure 14D:
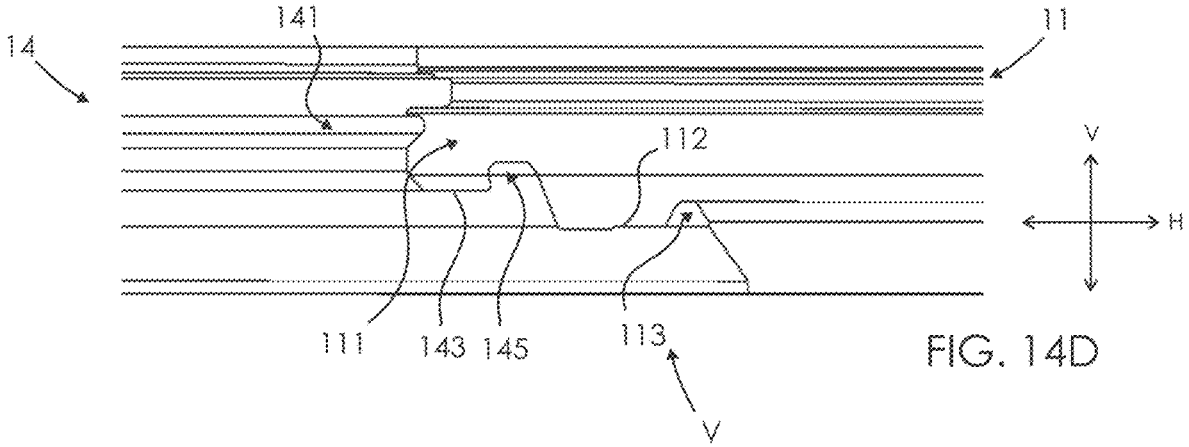

As derivable from FIG. 11C, some features of the second mechanical locking device 60 at the third edge 13', in the vertical direction or normal direction, overlap elements of the exemplary first mechanical locking device 50' at the first edge 11'. For example, the insertion groove 133 at least partially overlaps the locking element 113' of the first mechanical locking device 50' in the vertical direction, or normal direction, whereby a portion of the locking element 113' may be excised when forming the insertion groove 133. Thereby, at least portions of the locking element 113' of the first mechanical locking device 50' does not extend continuously in the intersection U' and consequently the locking element 113' is not able to seal properly against the locking groove 124' and/or upper surface 124*a*' of the first mechanical locking device 50' at the second edge 12' of an adjacent building panel, when assembling the building panels or in the assembled position of the building panels. Further, if fluid is present on the locking strip 112' of the first mechanical locking device 50' it may more easily migrate past the locking element 113' at the position where it is not continuous. Thereby, the capability of the joint or assemble to hinder fluid penetration is jeopardized.

Also, a portion of the insertion groove 133 overlaps the locking strip 112' of the first mechanical locking device 50' in a vertical direction, or in a normal direction, whereby fluid may migrate from the upper surface 112*a*' of the locking strip 112' and into the insertion groove 133 at the intersection U'.

Further, the formation of the locking strip 139 of the second mechanical locking device 60, in a vertical or normal direction, overlaps the locking element 113' of the first mechanical locking device 50', whereby a portion of the locking element 113' may be excised when forming the locking strip 139 of the second mechanical locking device 60. Thereby, at least portions of the locking element 113' of the first mechanical locking device 50' does not extend continuously in the intersection U', and consequently the locking element 113' is not able to seal properly against the locking groove 124' and/or upper surface 124*a*' of the first mechanical locking device 50' at the second edge 12' of an adjacent building panel, when assembling the building panels or in the assembled position of the building panels. Further, if fluid is present on the locking strip 112' of the first mechanical locking device 50' it may more easily migrate past the locking element 113' at the position where it is not continuous. Thereby, the capability of the joint or assemble to hinder fluid penetration is jeopardized.

Additionally, a portion of the locking strip 139 of the second mechanical locking device 60 overlaps the locking strip 112' of the first mechanical locking device 50' in a vertical or normal direction, whereby fluid may migrate from the upper surface 112*a*' and onto the locking strip 139 of the second mechanical locking device 60 at the intersection U'. Thereby, the capability of the joint or assemble to hinder fluid penetration is jeopardized.

FIGS. 12A-12D show details of the intersection U between the first edge 11 and the third edge 13 of a building panel 1 according to an embodiment of the present disclosure and inventive concept.

The locking element 113 of the first mechanical locking device 50 at the first edge 11 is provided or formed in a vertical or normal direction below the insertion groove 133 of the second mechanical locking device 60 at the third edge 13. In particular, an uppermost surface of the locking element 113 is provided or formed in a vertical or normal direction below a lowermost point of the insertion groove 133.

By providing the locking element 113 of the first mechanical locking device 50 at the first edge 11 in a vertical or normal direction below the insertion groove 133 of the second mechanical locking device 60 at the third edge 13, the locking element 113 is able to extend continuously in the intersection U between the first edge 11 and the third edge 13. Thereby, the locking element 113 is able to seal against the locking groove 124 at the second edge 12 of adjacent building panels at the intersection U between the first edge 11 and the third edge 13.

Additionally, fluid, such water, is thereby hindered by the locking element 113 of the first mechanical locking device 50 from migrating or flowing from the locking strip 112 of the first mechanical locking device 50 in a direction perpendicular to the first edge 11 and pass the locking element 113 down towards the back surface 16 of the building panel 1.

The locking strip 112 of the first mechanical locking device 50 at the first edge 11 is provided and/or formed in a vertical or normal direction below the upper surface 139*a* of the locking strip 139 of the second mechanical locking device 60 at the third edge 13.

By providing and/or forming the upper surface 112*a* of the locking strip 112 of the first mechanical locking device 50 at the first edge 11 below the upper surface 139*a* of the locking strip 139 of the second mechanical locking device 60 at the third edge 13, the upper surface 112*a* is able to extend continuously in the intersection U. Thereby the upper surface 112*a* of the locking strip 112 of the first mechanical locking device 50 is able to seal against the lower surface 121*b* of the locking tongue 121 of the first mechanical locking device 50 at the second edge 12 of an adjacent building panel 2, at the intersection U between the first edge 11 and the third edge 13.

The upper surface 112*a* of the locking strip 112 of the first mechanical locking device 50 at the first edge 11 is provided and/or formed in a vertical or normal direction below the insertion groove 133 of the second mechanical locking device 60 at the third edge 13.

By providing and/or forming the upper surface 112*a* of the locking strip 112 of the first mechanical locking device 50 at the first edge 11 below the insertion groove 133 of the second mechanical locking device 60 at the third edge 13, the upper surface 112*a* may extend continuously in the intersection U between the first edge 11 and the third edge 13. Thereby, the upper surface 112*a* of the locking strip 112 of the first mechanical locking device 50 is able to seal against the lower surface 121*b* of the locking tongue 121 of the first mechanical locking device 50 at the second edge 12 of an adjacent building panel at the intersection U between the first edge 11 and the third edge 13, when assembling the building panels, and maintain that seal in the assembled position of the building panels.

FIGS. 13A-13D show details of the intersection V' between the first edge 11' and the fourth edge 14 of the exemplary building panel 1', comprising the exemplary first locking device 50'. The formation of the locking groove 145 of the second mechanical locking device 60 has excised side portions of the locking element 113' and portions of the locking strip 112' of the first mechanical locking device 50'. Thereby the side portions of the locking element 113' of the first mechanical locking device 50' is not able to properly seal against the locking groove 124 of the first mechanical locking device 50' of an adjacent building panel at the intersection V'. Also, fluid may then migrate, for example, from the locking strip 112 of the first mechanical locking device 50' of the first building panel 1 and/or the adjacent building panel 3, into the locking groove 124 of the first mechanical locking device 50' at the intersection V'.

FIGS. 14A-14D show details of the intersection V between the first edge 11 and the fourth edge 14 of a building panel 1 according to an embodiment of the present disclosure and inventive concept.

Vertical extent configured to accommodate the second locking device 60 at the fourth edge 14.

By providing and/or forming the locking element 113 of the first mechanical locking device 50 at the first edge 11 with its vertical extent, or extent in the normal direction, positioned in a vertical or normal direction below the upper surface 145*a* of the locking groove 145 of the second mechanical locking device 60 at the fourth edge 14, the vertical extent, or extent in the normal direction, of the locking element 113 of the first mechanical locking device 50 may be excised due to the formation of the locking groove 145 of the second mechanical locking device 60. Thereby, the locking element 113 may extend continuously to the intersection V. In particular, the locking element 113 may extend continuously to the intersection V where, in the assembled position of the building panels 1, 3, the locking element 113 is contiguous with the locking element of intersection U, curtesy of the locking element 113. Thereby, fluid, such as water, may be hindered from migrating from the locking strip 112 of the first mechanical locking device 50 into the locking groove 145 of the second mechanical locking device 60.

By providing the locking element 113 of the first mechanical locking device 50 at the first edge 11 with its vertical or normal extent positioned in a vertical or normal direction below the upper surface 145*a* of the locking groove 145 of the second mechanical locking device 60 at the fourth edge 14, the side portions of the locking element 113 of the first mechanical locking device 50 may better seal against the locking groove 124 of the first mechanical locking device 50 at the second edge 12 of adjacent building panel at the intersection V between the first edge 11 and the fourth edge 14, curtsey of the side portions not being excised by formation of the locking groove 145 of the second mechanical locking device 60.

The upper surface 112*a* of the locking strip 112 of the first mechanical locking device 50 at the first edge 11 is in a vertical or normal direction positioned or formed below the lower edge surface 143*b* of the lower edge portion 143 at the fourth edge 14.

By providing and/or forming the upper surface 112*a* of the locking strip 112 of the first mechanical locking device 50 at the first edge 11 below the lower edge surface 143*b* of the lower edge portion 143 at the fourth edge 14, the upper surface 112*a* may extend continuously to the intersection V between the first edge 11 and the fourth edge 14. Thereby the upper surface 112*a* of the locking strip 112 of the first mechanical locking device 50 is able to seal against the lower surface 121*b* of locking tongue 121 of the first mechanical locking device 50 at the second edge 12 of an adjacent building panel at the intersection V between the first edge 11 and the fourth edge 14. Thereby, fluid, such as water, may be hindered from migrating from the locking strip 112 of the first mechanical locking device 50 into the locking groove 145 of the second mechanical locking device 60.

FIG. 15 shows details of one possible displaceable tongue 131 configured to be arranged in the insertion groove 133 of the second mechanical locking device 60, as illustrated in e.g. FIGS. 3B, 4B and 5B. Such a displaceable tongue 131 is a separate part from the rest of the second mechanical locking device 60.

The displaceable locking tongue 131 has a longitudinal base portion 132*a* which continuously extends along the length of the displaceable locking tongue 131. Along the base portion 132*a* several elongated flexible or bendable parts 132*b* are provided. The elongated bendable parts 132*b* are integrally formed with the base portion 132*a* at a first end 132*c*. The opposite second end 132*d* of the bendable part 132*b* is configured to move freely between a resting position and an assembled position.

In the resting position, as illustrated in FIG. 15, the elongated bendable parts 132*b* extend away from the base portion 132*a*, with the second end 132*d* farthest away from the base portion 132*a*. In between the first end 132*c* and the second end 132*d* an elongated body 132*e* of the bendable part 132*b* is provided.

Between the elongated bendable part 132*b* and the base portion 132*a* there is provided a slot or a gap 132*f*, in the resting position. The bendable part 132*b* may bend downwards in the slot 132*f* towards the base portion 132*a*. In an assembled position the bendable parts 132*b* are bent into the slot 132*f*.

The displaceable locking tongue 131 is configured to be received in the displaceable tongue groove 133 of the second mechanical locking device 60, as illustrated in FIGS. 1B and 1*n* the wedge groove 141 of the second mechanical locking device 60.

Before assembling the adjacent building panels the displaceable locking tongue 131 is arranged in the insertion groove 133, with the bendable parts 132*b* facing into the insertion groove 133. In embodiments, the longitudinal base portion 132*a* may be arranged just outside the insertion groove 133.

During installation, a first building panel is vertically pushed down into a second building panel, in which the displaceable locking tongue 131 is arranged in the insertion groove 133. The first building panel pushes on the base portion 132*a* of the displaceable locking tongue 131, forcing the bendable parts 132*b* to be displaced into the slot 132*f* towards the base portion 132*a*, allowing the first building panel to continue down. When the first building panel is in the assembled position the longitudinal base portion 132*a* of the displaceable locking tongue 131 snaps into the wedge groove 141 of the second mechanical locking device 60 of the first building panel, locking the two building panels in the horizontal and vertical direction.

In any embodiment of the first mechanical locking device 50, such as illustrated in FIG. 3A, the first mechanical locking device 50 may optionally include, at the first edge 11, another locking tongue 119 projecting from the first vertical plane VP1. The locking tongue 119 is configured to be received in a corresponding locking groove 129 of the first mechanical locking device 50 at the second edge 12. The locking tongue 119 is provided between the front surface 15 and the upper surface 111*a* of the tongue groove 111 and/or the upper edge portion 118. The locking groove 129 recessing inwards from the first vertical plane VP1. The locking groove 129 being provided between the front surface 15 and the upper surface 121*a* of the locking tongue 121 and/or the upper edge portion 128 of the first mechanical locking device 50.

In any embodiment of the second mechanical locking device 60, for example as illustrated in FIG. 3B, the second mechanical locking device 60 may optionally include, at the fourth edge 14, an upper lip portion 149 configured to cooperate with a corresponding lower lip portion 138*b* at the third edge 13. The lower lip portion 138*b* may project from the second vertical plane VP2 and may be provided between the front surface 15 and the first plane M1 and/or the insertion groove 133. The upper lip portion 149 may be provided between the front surface 15 and the first plane M1 and/or the upper surface 141*a* of the wedge groove 141.

Figure 20:
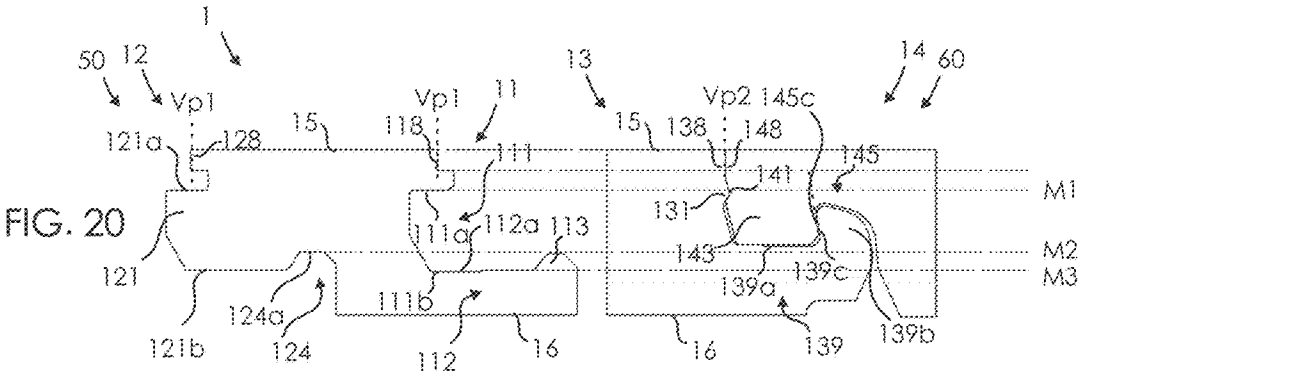
FIG. 20 is a schematic illustration of a first mechanical locking device according to an embodiment and a second mechanical locking device according to an embodiment.

In the embodiments illustrated in FIGS. 17 and 20, the locking tongue 131 of the second mechanical locking device 60 is stationary and formed out of the third edge 13 of the building panel 1. The wedge groove 141 is correspondingly formed out of the fourth edge 14 of the building panel 1. The locking tongue 131 and the wedge groove 141 may include cooperating locking surfaces for vertical locking in at least one vertical direction, or normal direction. The locking element 139*b* may have a locking surface 139*c* which overhangs a portion of the locking strip 139 to form an obtuse angle with the upper surface 139*a* of the locking strip 139, to thereby provide a vertical locking surface configured to cooperate with a corresponding locking surface 145*c* of the locking groove 145 of the second mechanical locking device 60, for vertical locking of adjacent panels in a horizontal plane. The upper surface 139*a* of the locking strip 139 may further cooperate with a lower surface 143*b* of a lower edge portion 143 at the fourth edge 14 to create a vertical locking.

In the embodiment illustrated in FIG. 18, the upper edge portion 138 at the third edge 13 overhangs the upper edge portion 148 at the fourth edge 14 for vertical locking of adjacent panels in a horizontal plane. Also, the locking element 139*b* may comprise a locking surface 139*c* which overhangs a portion of the locking strip 139 to form an obtuse angle with the upper surface 139*a* of the locking strip 139, to thereby provide a vertical locking surface configured to cooperate with a corresponding locking surface 145*c* of the locking groove 145 of the second mechanical locking device 60, for vertical locking of adjacent panels in a horizontal plane.

In the embodiment illustrated in FIG. 19, the second mechanical locking device 60 is configured for horizontal locking, by means of the cooperating locking surfaces 138, 148 at the third edge 13 and further edge 14, towards each other. The cooperating locking surface 145*c* of the locking groove 145 and the locking surface 139*c* of the locking strip 139 are configured for horizontal locking apart from each other. Vertical locking in a horizontal plane may be achieved by the provision of a lower lip portion 145*c* and an upper lip portion 139*c* one of the lower lip portion 145*c* or the upper lip portion 139*c* is designed to overhang the other as described in FIG. 18.

Figure 21:
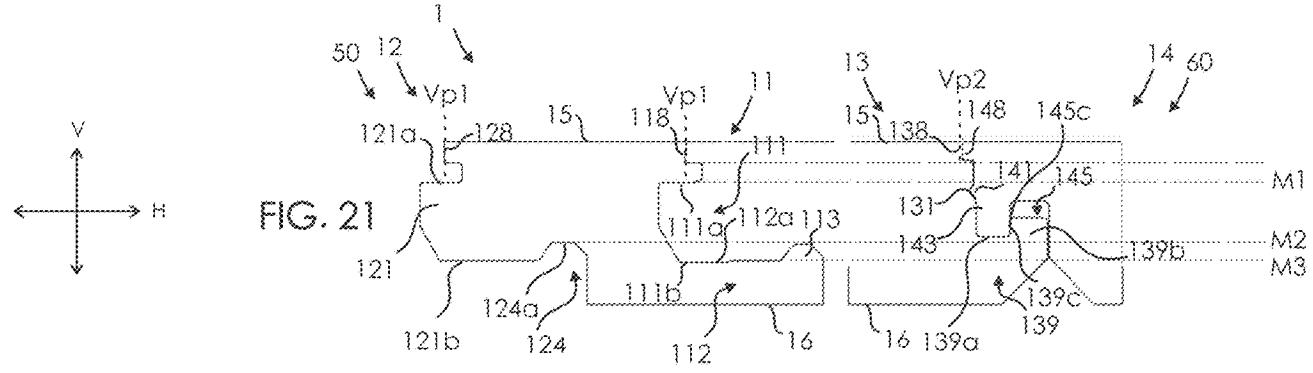
FIG. 21 is a schematic illustration of a first mechanical locking device according to an embodiment and a second mechanical locking device according to an embodiment.

In the embodiments of FIG. 21, the second locking tongue 131 is stationary and formed out of the third edge 13 of the building panel 1. The wedge groove 141 is correspondingly formed out of the fourth edge 14 of the building panel 1. The locking tongue 131 and the wedge groove 141 may comprise cooperating locking surfaces for vertical locking in at least one vertical direction.

Figure 22:
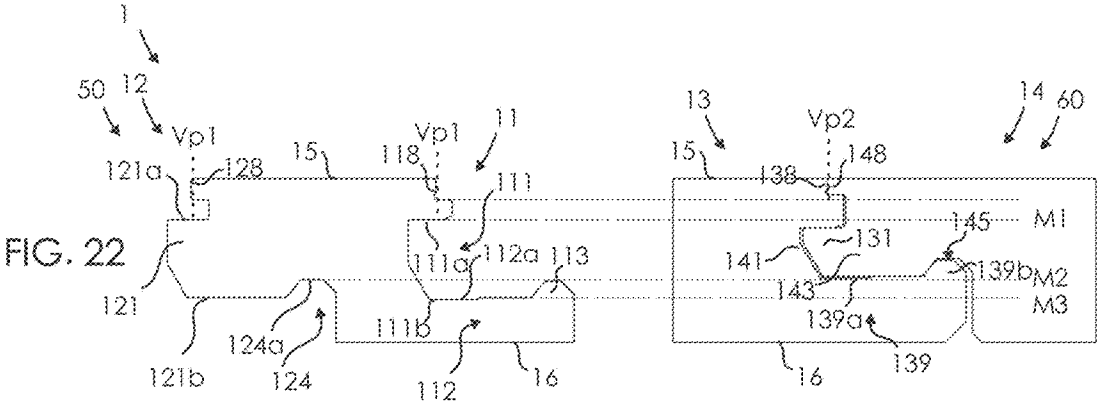
FIG. 22 is a schematic illustration of a first mechanical locking device according to an embodiment and a second mechanical locking device according to an embodiment.

FIG. 22 shows an embodiment of the second mechanical locking device 60 configured for horizontal and vertical locking of adjacent building panels by means of a folding F displacement. The second locking tongue 131 projecting from the second vertical plane VP2 at the fourth edge 14 is formed out of the fourth edge 14 and is configured to be received in the tongue groove 141 of the second mechanical locking device 60 provided in the third edge 13 by means of the folding displacement, for vertical locking of adjacent panels in an assembled position in a horizontal plane.

Figure 23B:
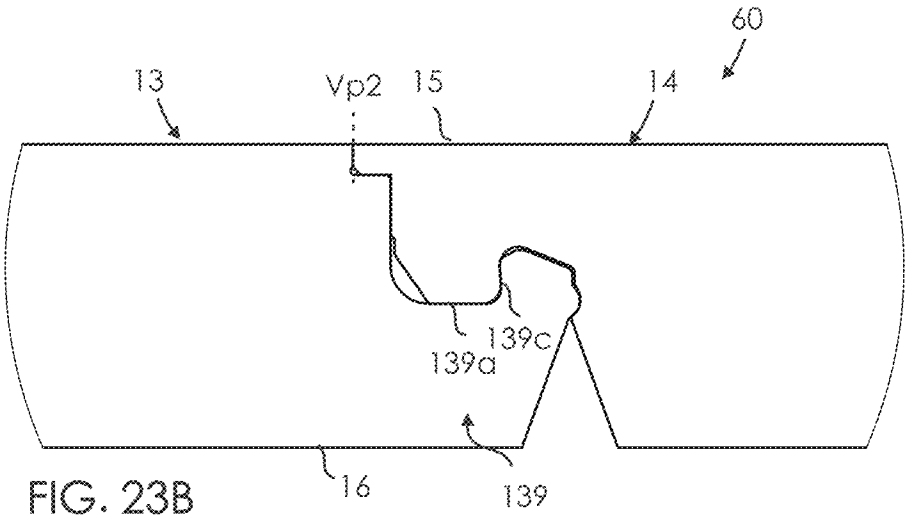
FIGS. 23A-23C are schematic illustrations of a first mechanical locking device according to an embodiment and a second mechanical locking device according to an embodiment.
Figure 23A:
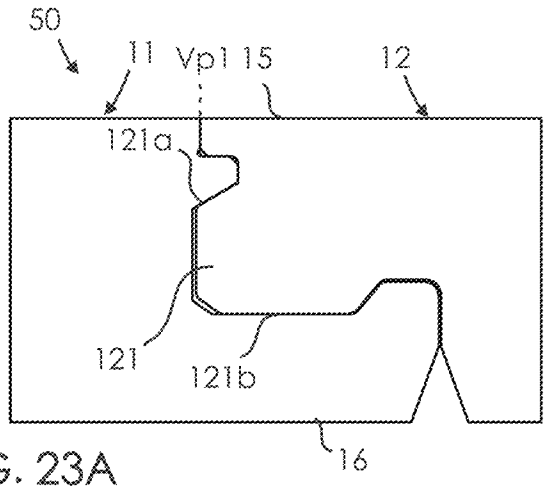
Figure 23C:
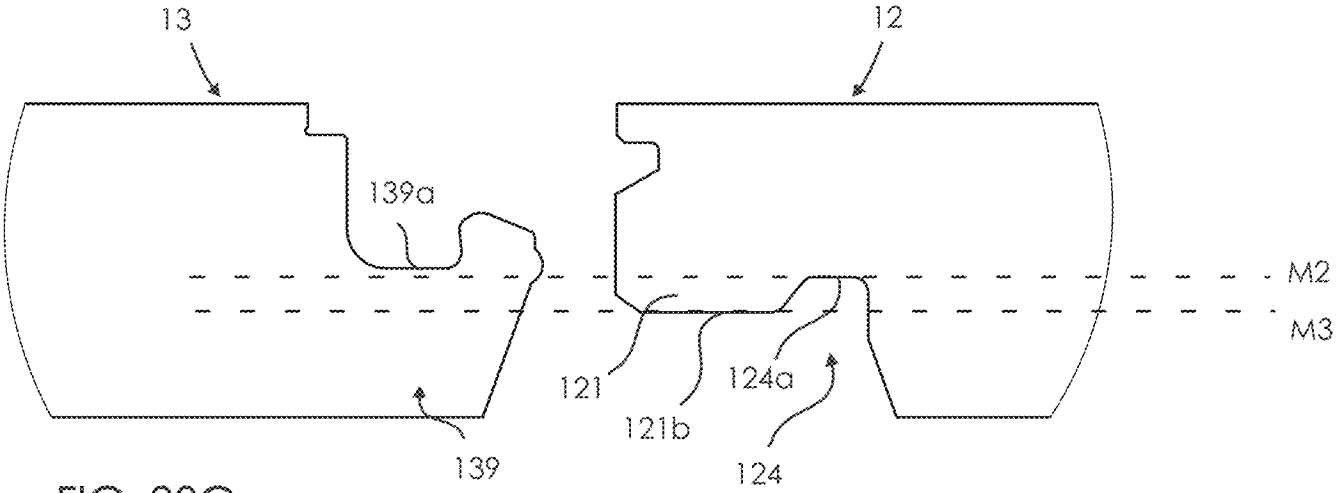
Figure 25:
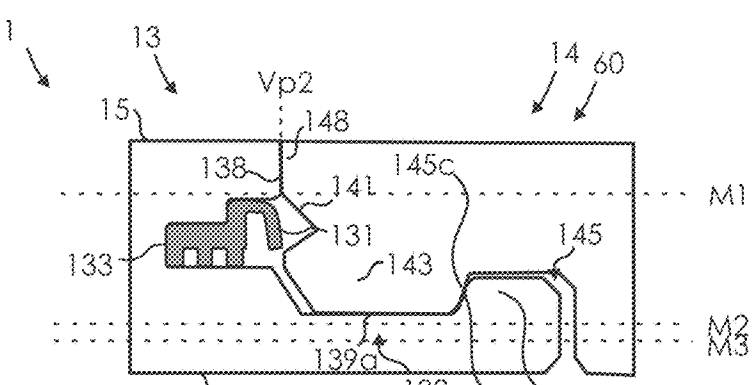
FIG. 25 is a schematic illustration of a second mechanical locking device according to an embodiment.
Figure 27:
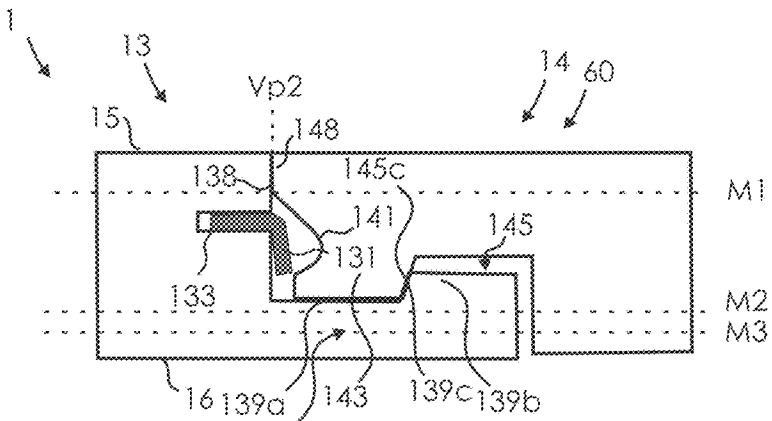
FIG. 27 is a schematic illustration of a second mechanical locking device according to an embodiment.
Figure 24:
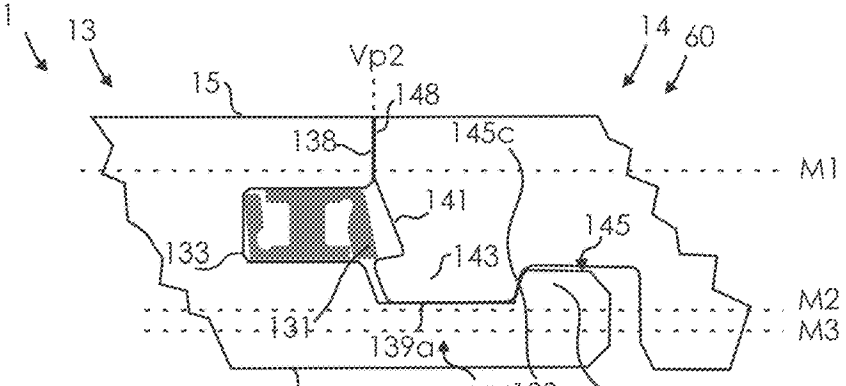
FIG. 24 is a schematic illustration of a second mechanical locking device according to an embodiment.
Figure 26:
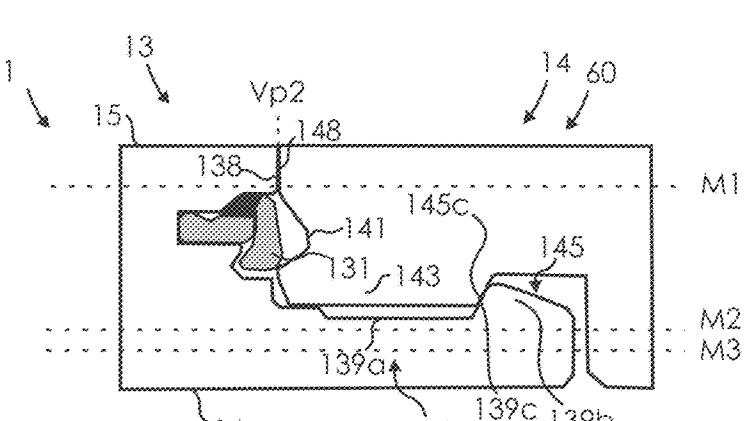
FIG. 26 is a schematic illustration of a second mechanical locking device according to an embodiment.
Figure 29:
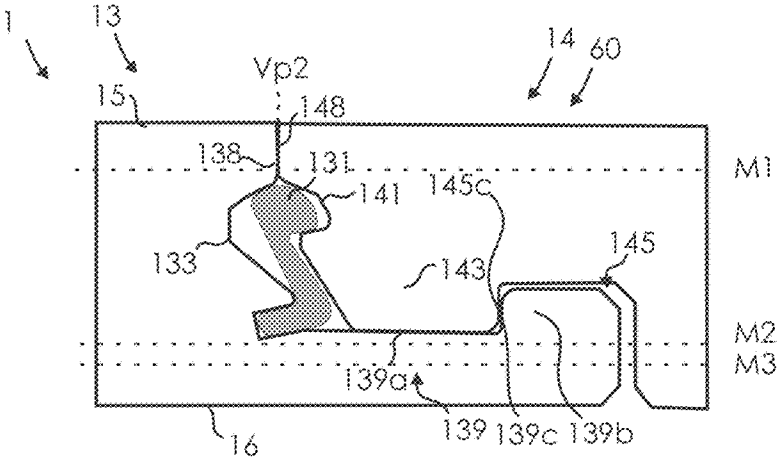
FIG. 29 is a schematic illustration of a second mechanical locking device according to an embodiment.
Figure 28:
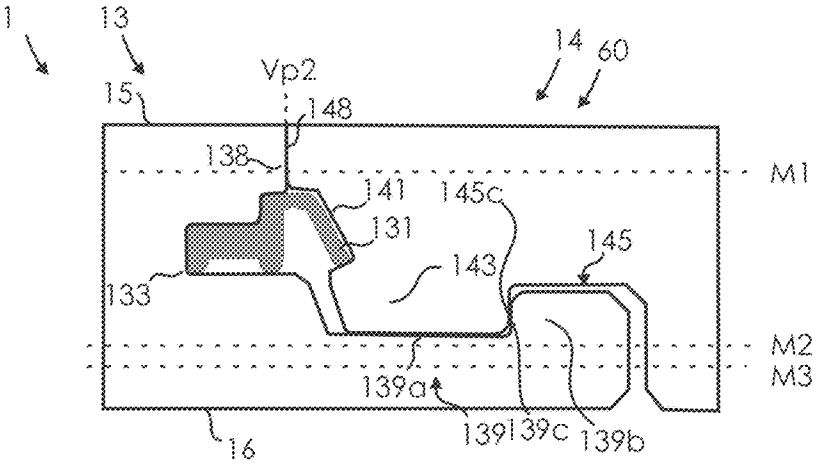
FIG. 28 is a schematic illustration of a second mechanical locking device according to an embodiment.
Figure 30:
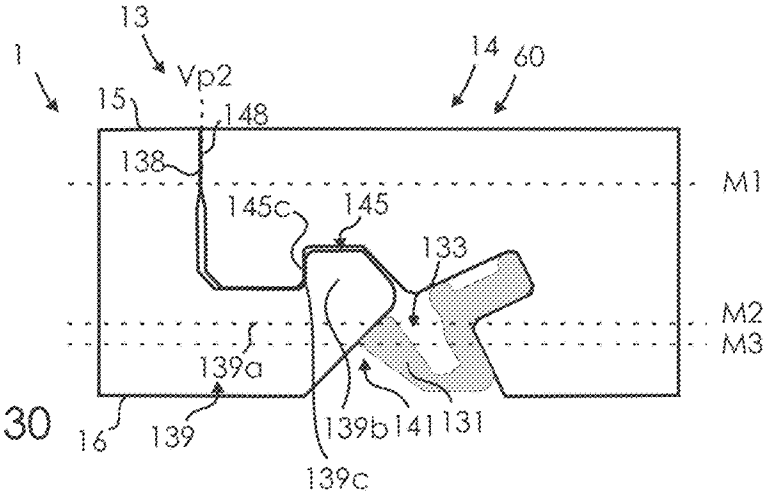
FIG. 30 is a schematic illustration of a second mechanical locking device according to an embodiment.

FIGS. 23A-23C illustrate yet another embodiment of a first mechanical locking device 50 and a second mechanical locking device 60 configured for horizontal and vertical locking of adjacent building panels by means of a folding displacement. Similar to what has been described for other embodiment, the first mechanical locking device includes a locking tongue 121 having a lower surface 121*b* configured to be situated below, in a direction perpendicular to the front surface 15 of the building panel, a lowermost point of the upper surface 139*a* of the locking strip 139 of the second mechanical locking device 60, as illustrated with plane M3. Like for the other embodiments, an advantage with this embodiment is that there will be no gaps or openings in the intersections between the second edge 12 and the third edge 13 and the fourth edge 14 respective since the creation of the upper surface 139 a of the locking strip 139 of the second mechanical locking device 60 will not cut or go through the entire locking tongue 121 of the first mechanical locking device 50.

FIGS. 24-30 show further embodiments of the second mechanical locking device 60. It should be appreciated that FIGS. 24-30 are schematic drawings which thus are not necessarily drawn to scale. In the shown embodiments the locking tongue 131 of the second mechanical locking device 60 is a displaceable locking tongue of different material than the panel. At least a portion of the tongue 131 may be flexible and/or resilient. An inner portion of the tongue 131 is inserted in the insertion groove 133 and an outer portion is configured to pivot in an unlocking direction to an unlocking position in response to a vertical displacement of a lower edge portion 143 of an adjacent panel, and in an opposite locking direction to cooperate with the wedge groove 141 of the adjacent panel to obtain a vertically locking position by means of resilient flexing of the outer portion of the locking tongue 131.

Figure 32:
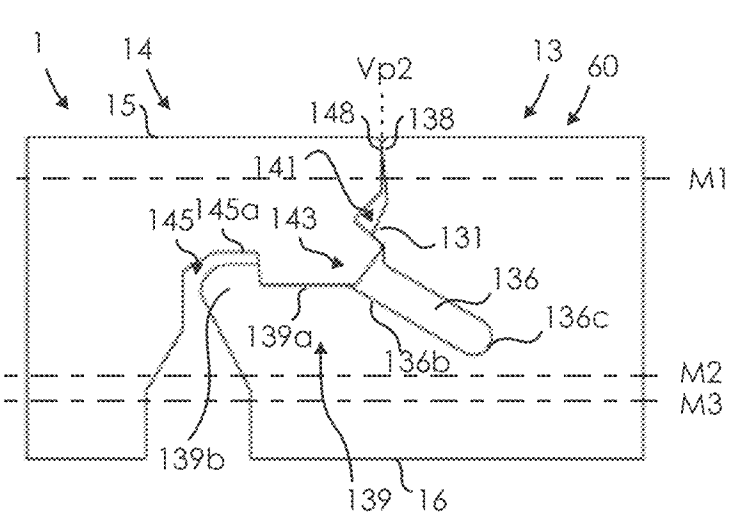
FIG. 32 is a schematic illustration of a second mechanical locking device according to an embodiment.
Figure 31:
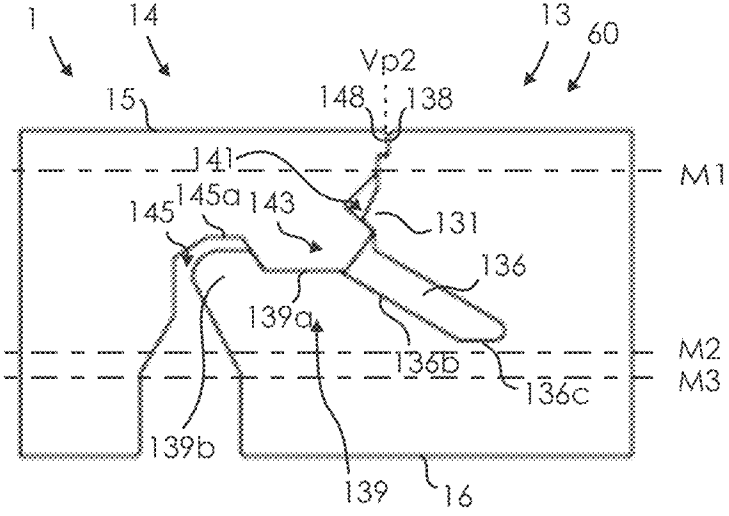
FIG. 31 is a schematic illustration of a second mechanical locking device according to an embodiment.

FIGS. 31-32 show further embodiments of the second mechanical locking device 60. It should be appreciated that FIGS. 31-32 are schematic drawings which thus are not necessarily drawn to scale.

As derivable from the drawings, one of the third edge 13 or fourth edge 14 comprises the locking strip 139 projecting from the second vertical plane VP2 and the locking tongue 131 of the second mechanical locking device 60 here formed out of the panel edge, for example by means of cutting or milling. The wedge groove 141 is formed in the other of the third edge or fourth edge, such as the fourth edge 14 as shown in FIGS. 31-32. A flex-groove 136 may be provided between the locking strip 139 and the locking tongue 131 of the second mechanical locking device 60 and be configured to facilitate that the locking strip 139 can flexibly be displaced. The flex-groove 136 may be configured to facilitate that the locking strip 139 of the second mechanical locking device 60 may flexibly receive the lower edge portion 143 of the adjacent edge and biasing the locking strip 139 against the locking tongue 131 via the lower edge portion 143 by acting thereon, in the assembled position. This may be achieved by means of the flex-groove 136 being formed as and/or comprising a cut into the panel 1 between the locking tongue 131 and the upper surface 139*a* of the second mechanical locking device 60.

In a non-limiting example, the length in the depth-direction of the flex-groove 136 from the opening adjacent the upper surface 139*a* to an innermost wall 136*c* of the flex-groove 136 may correspond to between 20-40% of the thickness of the panel 1. In a further example, the extent of the flex-groove 136, in the thickness-direction of the panel 1, may correspond to 15-30% of the thickness of the panel 1.

In the embodiments of FIGS. 31-32 an opening of the flex-groove 136 is provided adjacent the upper surface 139*a* and thus the lower inner wall of the wedge groove may be contiguous with the upper surface 139*a*. The flex-groove 136 may be sloping downwards towards the back surface 16 and a substantial or major portion of the flex-groove may thus be provided below the upper surface 139*a*. The lower wall 136*b* of the flex-groove 136 may form an angle with the back surface 16 of 10 to 30°, preferably about 20°.

As derivable from FIGS. 31-32, the wedge groove 141 may be provided entirely below the first plane M1. Also, the locking tongue 131 of the second mechanical locking device 60 may be provided entirely below the first plane M1. Further, the third plane M3 may extend below the lowest point of the flex-groove 136, such as closer to the back surface 16. Preferably, the second plane M2 extends below the lowest point of the flex-groove 136, such as closer to the back surface 16. Further, the third plane M3 may extend below the lowest point of the upper surface 139*a* of the locking strip 139, such as closer to the back surface 16. Preferably, the second plane M2 extends below the lowest point of the upper surface 139*a* of the locking strip 139, such as closer to the back surface 16.

Accordingly, the wedge groove 141, the upper surface 139*a* of the locking strip 139 and the flex-groove 136 may be provided between the first plane M1 and the third plane M3, preferably between the first plane M1 and the second plane M2.

The above references to the specification should not be construed as limiting the scope of the claimed subject matter to the various embodiments described in the specification, or otherwise as a vehicle for importing limitations into the claims from the specification. No representation is made that the above-identified portions of the disclosure are the only basis for support for the claimed subject matter.

Items

ITEM 1. A building panel 1, such as a floor panel, wall panel or wall panel, comprising:

a first mechanical locking device 50 at a respective first edge 11 and an opposite second edge 12, such as long edges, for horizontal and vertical locking of similar or essentially identical panels in an assembled position; a second mechanical locking device 60 at a respective third edge 13 and an opposite fourth edge 14 for horizontal and vertical locking of similar panels or essentially identical panels in an assembled position, wherein the first mechanical locking device 50 comprises at the first edge 11 a tongue groove 111 configured to receive a first locking tongue 121 of the second edge 12 of an adjacent second panel 2.

ITEM 2. The building panel 1 according to item 1, wherein said first locking tongue 121 is configured to accommodate said second mechanical locking device 60 therein, such as accommodating formation of said second mechanical locking device 60 therein.

ITEM 3. The building panel 1 according to item 1 or 2, wherein said tongue groove 111 is configured to accommodate said second mechanical locking device 60 therein, such as accommodating formation of said second mechanical locking device 60 therein.

ITEM 4. The building panel 1 according to any one of items 1 to 3, wherein, in the thickness-direction of the panel 1, the extent of said locking tongue 121 is configured to accommodate the extent of the second mechanical locking device 60 of the third edge 13 and/or fourth edge 14.

ITEM 5. The building panel 1 according to any one of items 1 to 4, wherein, in the thickness-direction of the panel 1, the extent of said tongue groove 111 is configured to accommodate the extent of the second mechanical locking device 60 of the third edge 13 and/or fourth edge 14.

ITEM 6. The building panel according to any one of items 1 to 5, wherein the second mechanical locking device 60 comprises at the third edge 13, a displacement groove 133 provided with a displaceable locking tongue 131 configured to cooperate with a wedge groove 141 of the fourth edge 14 of an adjacent panel for vertical locking of the adjacent panels; a second locking element 139*b* configured to cooperate with a second locking groove 145 of the adjacent panel for horizontal locking of the adjacent panels.

ITEM 7. The building panel according to any one of the preceding items 1 to 6, wherein the second mechanical locking device 60 comprises at the fourth edge 14, a wedge groove 141 configured to receive a displaceable locking tongue 131 of the third edge 13 of an adjacent panel, for vertical locking of the panels; a second locking groove 145 configured to receive a locking element 139*b* of the third edge 13 of an adjacent panel, for horizontal locking of the adjacent panels.

ITEM 8. The building panel 1 according to any one of the preceding items 1 to 7, wherein the second mechanical locking device 60 is positioned, in the thickness-direction of the panel 1, between vertically-locking surfaces of the first mechanical locking device 50 at the first edge 11 and/or second edge 12.

ITEM 9. The building panel 1 according to any one of the preceding items 1 to 8, wherein the first mechanical locking device 50 comprises at the first edge 11 a tongue groove 111 configured to receive a locking tongue 121 of the second edge 12, preferably by means of a folding displacement F, for vertical locking of adjacent similar or essentially identical panels 1, 2 in the assembled position; said locking tongue 121 comprising an upper surface 121*a* and a lower surface 121*b*, wherein said second mechanical locking device 60 of the third edge 13 and/or fourth edge 14 is positioned, in the thickness-direction of the panel, between said upper surface 121*a* and said lower surface 121*b*.

ITEM 10. The building panel 1 according to any one of the preceding items 1 to 9, wherein the first mechanical locking device 50 comprises at the first edge 11 a tongue groove 111 configured to receive a locking tongue 121 of the second edge 12, preferably by means of a folding displacement F, for vertical locking of adjacent similar or essentially identical panels 1, 2 in the assembled position; said locking groove 111 comprising an upper surface 111*a* and a lower surface 111*b*, 112*a*, wherein said second mechanical locking device of the third edge 13 and/or fourth edge 14 is positioned, in the thickness-direction of the panel 1, between said upper surface 111*a* and said lower surface 111*b*, 112*a*.

ITEM 11. The building panel 1 according to the preceding item 10, wherein the second mechanical locking device 60 comprises at one of the third 13 or fourth edge 14 a wedge groove 141 configured to receive a second locking tongue, such as a displaceable locking tongue 131, of the other of the third edge 13 and fourth edge 14, preferably by means of a vertical V displacement, such as vertical folding VF, for vertical locking of similar or essentially identical adjacent panels 1, 3 in an assembled position, preferably said second locking tongue 131 is configured to displace in a displacement groove 133 provided in said other of the third edge 13 or fourth edge 14, wherein said wedge groove 141 is positioned, in the thickness-direction of the panel 1, between said upper surface 121*a* and said lower surface 121*b*.

ITEM 12. The building panel according to any one of the preceding item 10 to 11, wherein said displacement groove 133 is positioned, in the thickness-direction of the panel 1, between said upper surface (121*a*) and said lower surface 121*b*.

ITEM 13. The building panel according to any one of the preceding items 1 to 12, wherein immediately juxtaposed upper edge portions 138, 148 of the third edge 13 and fourth edge 14 form, in the assembled position, a second vertical plane VP2, and wherein the second mechanical locking device 60 comprises a locking strip 139 projecting from said second vertical plane VP2, wherein an upper surface 139*a* of said locking strip 139 is positioned, in the thickness-direction of the panel 1, between, preferably entirely between, said vertically-locking surfaces of the first mechanical locking device 50.

ITEM 14. The building panel according to any one of the preceding items 1 to 13, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein an upper surface 112*a* of said locking strip 112 is positioned, in the thickness-direction of the panel 1, below, preferably entirely below, the upper surface 139*a* of the locking strip 139 of the second mechanical locking device 60, such as closer to the back surface 16 of the panel 1.

ITEM 15. The building panel according to any one of the preceding items 1 to 14, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, and a locking element 113 projecting from said locking strip 112 in a direction transverse the locking strip 112, wherein the locking element 113 is positioned, in the thickness direction of the panel, below, preferably entirely below, the upper surface 139*a* of the locking strip 139 of the second mechanical locking device 60, such as closer to the back surface 16 of the panel 1.

ITEM 16. The building panel according to any one of the preceding items 1 to 15, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein an upper surface 112*a* of said locking strip 112 is positioned, in the thickness direction of the panel, below, preferably entirely below, the displacement groove 133 of the second mechanical locking device 60, such as closer to the back surface 16 of the panel 1.

ITEM 17. The building panel according to any one of the preceding items 1 to 16, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein an upper surface 139*a* of the locking strip 139 of the second mechanical locking device 60, is positioned, in the thickness direction of the panel, above, preferably entirely above, the lower surface 121*b* of the first locking tongue 121, such as closer to the front surface 15 of the panel 1.

ITEM 18. The building panel according to any one of the preceding items 1 to 17, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein the displacement groove 133 of the second mechanical locking device 60, is positioned, in the thickness direction of the panel, above, preferably entirely above, the lower surface 121*b* of the first locking tongue 121, such as closer to the front surface 15 of the panel 1.

ITEM 19. The building panel according to any one of the preceding items 1 to 18, wherein the wedge groove 141 of the fourth edge 14 is positioned, in the thickness direction of the panel, below, preferably entirely below, the upper surface 121*a* of the first locking tongue 121, such as closer to the back surface 16 of the panel 1.

ITEM 20. The building panel according to any one of the preceding items 1 to 19, wherein said displacement groove 133 comprises an opening formed by an upper edge 141*a* and a lower edge 141*b*, wherein the displacement groove 133 slopes towards the back surface 16, in a direction from the opening thereof and into the displacement groove, wherein the displacement groove slopes with an angle to of less than 15° in relation to a back surface 16 of the panel 1, preferably less than 10°, more preferably less than 7°, such as 6° or 5°, most preferably about 5°.

ITEM 21. The building panel according to any one of the preceding items 1 to 20, wherein the first mechanical locking device 50 and the second mechanical locking device 60 are formed at least partially by means of carving or cutting tools, such as rotating cutting tools.

ITEM 22. A set of building panels according to any one of the preceding items.

ITEM 23. A building panel 1 or a set of such panels 1, such as a floor panel or wall panel, comprising:

a first mechanical locking device 50 at a respective first edge 11 and an opposite second edge 12, such as long edges, for horizontal and vertical locking of similar or essentially identical panels in an assembled position by means of a folding F displacement; a second mechanical locking device 60 at a respective third edge 13 and an opposite fourth edge 14 for horizontal and preferably vertical locking of similar panels or essentially identical panels in an assembled position, wherein the first mechanical locking device 50 comprises at the first edge 11 a first tongue groove 111 configured to receive a first locking tongue 121 of the second edge 12 of an adjacent panel for locking the adjacent panels in at least one vertical direction; wherein immediately juxtaposed upper edge portions 138, 148 of the third edge 13 and fourth edge 14 form, in the assembled position, a second vertical plane VP2, and wherein a locking strip 139 is projecting from said second vertical plane VP2, wherein an upper surface 139*a* of said locking strip 139 is provided, in the thickness-direction of the panel 1, between an upper surface 121*a* and a lower surface 121*b* of said first locking tongue 121, such as entirely between.

ITEM 24. The building panel 1 according to item 23, wherein immediately juxtaposed upper edge portions 118, 128 of the first edge 11 and second edge 12 form, in the assembled position, a first vertical plane VP1; wherein the first locking tongue 121 is projecting from the first vertical plane VP1 at the second edge 12 and a locking strip 112 is projecting from said vertical plane VP1 at the first edge 11;

a locking element 113 is projecting from said locking strip 112 in a direction transverse the locking strip 112; said locking element 113 configured to be received in a first locking groove 124 of the second edge 12 by means of said folding displacement; wherein an uppermost surface 124*a* of said first locking groove 124 is provided, in the thickness-direction of the panel, between said lower surface 121*b* of the first locking tongue 121 and the upper surface 139*a* of the first locking strip 139, such as the entire upper surface 139*a* and/or a lowermost point thereof.

ITEM 25. The building panel 1 according to any of the preceding items 23 or 24, wherein one of the third edge 13 or fourth edge 14 comprises an a second locking tongue 131 configured to cooperate with a wedge groove 141 of the other of the third edge 13 or fourth edge 14 for vertical locking of adjacent edges, wherein the wedge groove 141 is provided, such as entirely provided, in the thickness-direction of the panel 1, between said upper surface 121*a* of the first locking tongue 121 and said uppermost surface 124*a* of the first locking groove 124.

ITEM 26. The building panel 1 according to any one of items 23 to 25, wherein the second locking tongue 131 is a displaceable locking tongue provided in an insertion groove 133 in said one of the third edge 13 or fourth edge 14, wherein the insertion groove 133 is provided, such as entirely provided, in the thickness-direction of the panel (1), between said upper surface 121*a* and said lower surface 121*b* of the first locking tongue 121.

ITEM 27. The building panel 1 according to item 25, wherein the insertion groove 133 is provided, such as entirely provided, in the thickness-direction of the panel 1, between said upper surface 121*a* of the first locking tongue 121 and said uppermost surface 124*a* of the first locking groove 124.

ITEM 28. The building panel 1 according to any one the preceding items 23 to 27, wherein a second locking element 139*b* is projecting from said second locking strip 139 in a direction perpendicular the second locking strip 139, wherein said second locking element 139 is provided vertically V above said lower surface 121*b* of the first locking tongue 121, preferably above said upper surface 124*a* of the first locking groove 124.

ITEM 29. The building panel 1 according to any one the preceding items 25 to 28, wherein a greatest distance, in the thickness-direction, between an upper edge of the wedge groove 141*a* and the upper surface 139*a* of the second locking strip 139 or the insertion groove 133, such as a lowermost point of the upper surface 139*a* or lowermost point of insertion groove 133, is accommodated within the distance, in the thickness-direction, between the upper surface 121*a* and the lower surface 121*b* of the first locking tongue 121, preferably within the distance between upper surface 121*a* of the first locking tongue 121 and the upper surface 124*a* of the first locking groove 124.

ITEM 30. The building panel 1 according to any one the preceding items 26 to 28, wherein a greatest distance, in the thickness-direction, between an upper edge of the insertion groove 135*a* and the upper surface 139*a* of the second locking strip 139 or the insertion groove 133, such as a lowermost point of the upper surface 139*a* or lowermost point of insertion groove 133, is accommodated within the distance, in the thickness-direction, between the upper surface 121*a* and the lower surface 121*b* of the first locking tongue 121, preferably within the distance between upper surface 121*a* of the first locking tongue 121 and the upper surface 124*a* of the first locking groove 124.

ITEM 31. The building panel 1 according to any one the preceding items 25 to 30, wherein a distance, in the thickness-direction, between an upper edge of the wedge groove 141*a* and the upper surface 139*a* of the second locking strip 139, such as a lowermost point of the upper surface 139*a*, is accommodated within the distance, in the thickness-direction, between the upper surface 111*a* and the lower surface 111*b* of the first locking groove 111.

ITEM 32. The building panel 1 according to any one the preceding items 23 to 31, wherein a lower surface 143*b* of the fourth edge 14 is provided, in the thickness-direction of the panel 1, between the upper surface 124*a* of the first locking groove 124 and the upper surface 121*a* of the first locking tongue 121.

ITEM 33. The building panel 1 according to any one of items 23 to 32, wherein, in the thickness-direction of the panel 1, the extent of said locking tongue 121 is configured to accommodate the extent of the second mechanical locking device 60 of the third edge 13 and/or fourth edge 14.

ITEM 34. The building panel 1 according to any one of items 23 to 33, wherein, in the thickness-direction of the panel 1, the extent of said tongue groove 111 is configured to accommodate the extent of the second mechanical locking device 60 of the third edge 13 and/or fourth edge 14.

ITEM 35. The building panel 1 according to any one of the preceding items 23 to 34, wherein the second mechanical locking device 60 is positioned, in the thickness-direction of the panel 1, between vertically-locking surfaces 121*a*, 111*a*, 121*b*, 111*b* of the first mechanical locking device 50 at the first edge 11 and/or second edge 12, in particular, the insertion groove 133, the wedge groove 141, the locking element 139*b* and preferably the upper surface 139*a* of the second locking strip are provided between a first pair of cooperating vertically-locking surfaces 121*a*, 111*a* and a second pair of cooperating vertically-locking surfaces 121*b*, 111*b* of the first mechanical locking device 50.

ITEM 36. The building panel according to any one of the preceding items 23 to 35, wherein immediately juxtaposed upper edge portions 138, 148 of the third edge 13 and fourth edge 14 form, in the assembled position, a second vertical plane VP2, and wherein the second mechanical locking device 60 comprises a locking strip 139 projecting from said second vertical plane VP2, wherein an upper surface 139*a* of said locking strip 139 is positioned, in the thickness-direction of the panel 1, between, said upper surface 121*a* of the first locking tongue 121 and said upper surface 124*a* of the first locking groove 124.

ITEM 37. The building panel according to any one of the preceding items 23 to 36, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein an upper surface 112*a* of said locking strip 112 is positioned, in the thickness-direction of the panel 1, below, preferably entirely below, the upper surface 139*a* of the locking strip 139 of the second mechanical locking device 60, such as closer to the back surface 16 of the panel 1.

ITEM 38. The building panel according to any one of the preceding items 23 to 37, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, and a locking element 113 projecting from said locking strip 112 in a direction transverse the locking strip 112, wherein the locking element 113 is positioned, in the thickness direction of the panel, below, preferably entirely below, the upper surface 139*a* of the locking strip 139 of the second mechanical locking device 60, such as closer to the back surface 16 of the panel 1.

ITEM 39. The building panel according to any one of the preceding items 23 to 38, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1, wherein an upper surface 112*a* of said locking strip 112 is positioned, in the thickness direction of the panel, below, preferably entirely below, the insertion groove 133 of the second mechanical locking device 60, such as closer to the back surface 16 of the panel 1.

ITEM 40. The building panel according to any one of the preceding items 23 to 39, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1 at the first edge 11, wherein an upper surface 139*a* of the locking strip 139 of the second mechanical locking device 60, is positioned, in the thickness direction of the panel, above, preferably entirely above, the lower surface 121*b* of the first locking tongue 121, such as closer to the front surface 15 of the panel 1.

ITEM 41. The building panel according to any one of the preceding items 23 to 40, wherein immediately juxtaposed upper edge portions 118, 128 of the first edge 11 and second edge 12 form, in the assembled position, a first vertical plane VP1, and wherein the first mechanical locking device 50 comprises a locking strip 112 projecting from said vertical plane VP1 at the first edge 11, wherein the insertion groove 133 of the second mechanical locking device 60, is positioned, in the thickness direction of the panel, above, preferably entirely above, the lower surface 121*b* of the first locking tongue 121, such as closer to the front surface 15 of the panel 1.

ITEM 42. The building panel according to any one of the preceding items 23 to 41, wherein the wedge groove 141 of the fourth edge 14 is positioned, in the thickness direction of the panel, below, preferably entirely below, the upper surface 121*a* of the first locking tongue 121, such as closer to the back surface 16 of the panel 1.

ITEM 43. The building panel according to any one of the preceding items 26 to 42, wherein said insertion groove 133 comprises an opening formed by an upper edge 141*a* and a lower edge 141*b*, wherein the insertion groove 133 slopes towards the back surface 16, in a direction from the opening thereof and into the insertion groove, wherein the insertion groove slopes with an angle to of less than 15° in relation to a back surface 16 of the panel 1, preferably less than 10°, more preferably less than 7°, such as 6° or 5°, most preferably about 5°.

ITEM 44. The building panel according to any one of the preceding items 26 to 43, wherein the wedge groove is configured to facilitate flexible displacement of the second locking strip 139 in response to receiving the second locking tongue 131.

ITEM 45. The building panel according to any one of the preceding items 23 to 44, wherein the first mechanical locking device 50 and the second mechanical locking device 60 are formed at least partially by means of carving or cutting tools, such as rotating cutting tools.

ITEM 46. A set of building panels according to any one of the preceding items.

The invention claimed is:

1. A building panel or a set of such building panels, comprising:

a front surface and a back surface each extending between a first edge and an opposite second edge, and between a third edge and an opposite fourth edge, wherein the back surface is parallel and spaced apart to the front surface in a direction perpendicular to the front surface;

a first mechanical locking device arranged at the respective first edge and the opposite second edge for locking of similar or essentially identical building panels in directions parallel and perpendicular to the front surface in an assembled position;

a second mechanical locking device arranged at the respective third edge and the opposite fourth edge for locking of similar building panels or essentially identical building panels in directions parallel to the front surface in an assembled position, wherein the first mechanical locking device comprises, at the second edge, a locking tongue configured to cooperate with a tongue groove of a first mechanical locking device of an adjacent building panel, arranged at the first edge of said adjacent building panel for locking said building panels in at least a direction perpendicular to the front surface in an assembled position, wherein the second mechanical locking device comprises, at the third edge, a locking strip comprising a locking element configured to cooperate with a locking groove of a second mechanical locking device of an adjacent building panel, arranged at the fourth edge of said adjacent building panel for locking said building panels in at least a direction parallel to the front surface in an assembled position, wherein the locking element of the locking strip of the second mechanical locking device protrudes upward from an upper surface of the locking strip of the second mechanical locking device, wherein said locking tongue of said first mechanical locking device comprises a lowermost surface configured to cooperate with an upper surface of a locking strip of the first mechanical locking device of the adjacent building panel, arranged at the first edge of said adjacent building panel, in an assembled position, wherein, directly adjacent to said locking tongue, said second edge comprises a groove extending higher than the lowermost surface of said locking tongue and configured to receive an upwardly projecting locking element of the locking strip of the first mechanical locking device of the adjacent building panel, in the assembled position, and wherein a plane extending parallel with the front surface and through the lowermost surface of the locking tongue of said first mechanical locking device extends through the locking strip of said second mechanical locking device below a lowermost upper point of the locking strip of the second mechanical locking device, the lowermost upper point being a lowermost point of the upper surface of the locking strip of the second mechanical locking device along an entire surface area of the locking strip of the second mechanical locking device.

2. The building panel according to claim 1, wherein the plane extends between the upper surface and a lower surface of the locking strip of said second mechanical locking device.

3. The building panel according to claim 1, wherein a lowermost point of the upper surface of the locking strip of said second mechanical locking device is arranged above the plane in a direction perpendicular to the front surface.

4. The building panel according to claim 1, wherein the upper surface of the locking strip of the second mechanical locking device is configured to cooperate with a lowermost surface of a lower edge portion of a second mechanical locking device of an adjacent building panel, arranged at the fourth edge of said adjacent building panel for locking said building panels in at least a direction parallel to the front surface in an assembled position.

5. The building panel according to claim 1, wherein the locking tongue of the first mechanical locking device comprises a surface portion at least partly sloping towards the back surface of the building panel, wherein the surface portion extends from an outermost surface of the locking tongue to the lower surface of the locking tongue.

6. The building panel according to claim 5, wherein the surface portion comprises at least two sloping surface sections sloping towards the back surface of the building panel and in towards the building panel.

7. The building panel according to claim 6, wherein, the sloping surface section ending at the lower surface of the locking tongue is configured to start above a plane, defined by the uppermost portion of the locking element of the locking strip of the first mechanical locking device.

8. A set of building panels according to claim 1.

9. The building panel according to claim 1, wherein the locking tongue of the first mechanical locking device is formed as a single piece with other portions of the second edge.

10. A building panel or a set of such building panels, comprising:

a front surface and a back surface each extending between a first edge and an opposite second edge, and between a third edge and an opposite fourth edge, wherein the back surface is parallel and spaced apart to the front surface in a direction perpendicular to the front surface;

a first mechanical locking device arranged at the respective first edge and the opposite second edge for locking of similar or essentially identical building panels in directions parallel and perpendicular to the front surface in an assembled position;

a second mechanical locking device arranged at the respective third edge and the opposite fourth edge for locking of similar building panels or essentially identical building panels in directions parallel to the front surface in an assembled position, wherein the first mechanical locking device comprises, at the second edge, a locking tongue configured to cooperate with a tongue groove of a first mechanical locking device of an adjacent building panel, arranged at the first edge of said adjacent building panel for locking said building panels in at least a direction perpendicular to the front surface in an assembled position, wherein the second mechanical locking device comprises, at the third edge, a locking strip comprising a locking element configured to cooperate with a locking groove of a second mechanical locking device of an adjacent building panel, arranged at the fourth edge of said adjacent building panel for locking said building panels in at least a direction parallel to the front surface in an assembled position, wherein said locking tongue of said first mechanical locking device comprises a lowermost surface configured to cooperate with an upper surface of a locking strip of the first mechanical locking device of the adjacent building panel, arranged at the first edge of said adjacent building panel, in an assembled position, wherein a plane extending parallel with the front surface and through the lowermost surface of the locking tongue of said first mechanical locking device extends through the locking strip of the second mechanical locking device, and wherein the second mechanical locking device further comprises, at the third edge, an insertion groove configured to cooperate with a displaceable locking tongue and a wedge groove of a second mechanical locking device of an adjacent building panel, arranged at the fourth edge of said adjacent building panel for locking said building panels in at least a direction perpendicular to the front surface in an assembled position.

11. The building panel according to claim 10, wherein the insertion groove is formed to slope towards the back surface of the building panel.

12. The building panel according to claim 11, wherein a slope angle is less than 10°, in relation to a plane parallel to the front surface.

13. The building panel according to claim 10, wherein a lowermost point of the insertion groove of said second mechanical locking device is arranged above the plane in a direction perpendicular to the front surface.

14. The building panel according to claim 10, wherein the height of the locking tongue, between the uppermost surface and the lowermost surface in the direction perpendicular to the front surface, is configured to accommodate the insertion groove.

15. The building panel according to claim 10, wherein the height of the locking tongue, between the uppermost surface and the lowermost surface in the direction perpendicular to the front surface, is configured to accommodate the insertion groove, the displaceable locking tongue and the wedge groove.

16. The building panel according to claim 10, wherein the height of the locking tongue, between an uppermost surface and the lowermost surface in the direction perpendicular to the front surface, is configured to accommodate the insertion groove, the displaceable locking tongue, the wedge groove, the upper surface of the locking strip of the second mechanical locking device and at least an upper portion of the locking element of the second mechanical locking device.

* * * * *